US011360421B2

(12) United States Patent
Fujita et al.

(10) Patent No.: US 11,360,421 B2
(45) Date of Patent: Jun. 14, 2022

(54) SHEET SORTING DEVICE, POST-PROCESSING APPARATUS, AND IMAGE FORMING SYSTEM

(71) Applicants: Masakazu Fujita, Kanagawa (JP); Yasushi Tsuruoka, Kanagawa (JP); Takamasa Matsumoto, Kanagawa (JP); Hiroaki Utagawa, Kanagawa (JP); Ryohsuke Akaishi, Kanagawa (JP); Hisayoshi Sugawara, Kanagawa (JP)

(72) Inventors: Masakazu Fujita, Kanagawa (JP); Yasushi Tsuruoka, Kanagawa (JP); Takamasa Matsumoto, Kanagawa (JP); Hiroaki Utagawa, Kanagawa (JP); Ryohsuke Akaishi, Kanagawa (JP); Hisayoshi Sugawara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 280 days.

(21) Appl. No.: 16/823,463

(22) Filed: Mar. 19, 2020

(65) Prior Publication Data

US 2020/0310321 A1 Oct. 1, 2020

(30) Foreign Application Priority Data

Mar. 28, 2019 (JP) ..... JP2019-062839

(51) Int. Cl.
*B65H 31/00* (2006.01)
*G03G 15/00* (2006.01)
*B65H 31/30* (2006.01)

(52) U.S. Cl.
CPC ..... *G03G 15/6538* (2013.01); *B65H 31/3063* (2013.01); *B65H 2408/11* (2013.01)

(58) Field of Classification Search
CPC ..... B65H 31/3063; B65H 2408/11; B65H 2408/113; G03G 15/6547; G03G 15/6538
(Continued)

(56) References Cited

U.S. PATENT DOCUMENTS 5,344,130 A * 9/1994 Suzuki ..... B42C 1/12 270/58.02
6,634,640 B1 * 10/2003 Yoshizawa ..... G03G 15/6538 271/213

(Continued)

FOREIGN PATENT DOCUMENTS

JP 63-247262 10/1988
JP 2010-202339 9/2010

(Continued)

*Primary Examiner* — Leslie A Nicholson, III
(74) *Attorney, Agent, or Firm* — Harness, Dickey & Pierce, P.L.C.

(57) ABSTRACT

A sheet sorting device includes a plurality of trays, a tray shifter, a tray stop position detector, and circuitry. The plurality of trays is disposed in multiple stages in a vertical direction and configured to stack a sheet. The tray shifter is configured to move the plurality of trays separately in a tray shift direction. The tray stop position detector is configured to detect stop positions of the plurality of trays separately. The circuitry is configured to cause the tray shifter to move the plurality of trays to home positions in an initial operation, at least one tray having a home position opposite to a home position of another tray in the tray shift direction. The circuitry is configured to, while moving the plurality of trays at a same time in the initial operation, cause the tray shifter to move the trays in directions opposite to each other.

19 Claims, 21 Drawing Sheets

(58) Field of Classification Search
USPC ..... 270/58.18, 58.19
See application file for complete search history.

(56) References Cited

U.S. PATENT DOCUMENTS

| | | | | |
|---|---|---|---|---|
| 8,657,283 | B2 * | 2/2014 | Iwata | B65H 31/10 271/221 |
| 8,833,751 | B2 * | 9/2014 | Ishikawa | B65H 31/10 270/58.09 |
| 9,540,205 | B2 * | 1/2017 | Okamura | B65H 29/52 |
| 2011/0187044 | A1 | 8/2011 | Utagawa et al. | |
| 2012/0294695 | A1 | 11/2012 | Sasaki et al. | |
| 2013/0001848 | A1 | 1/2013 | Hidaka et al. | |
| 2013/0001849 | A1 | 1/2013 | Suzuki et al. | |
| 2013/0228965 | A1 | 9/2013 | Hoshino et al. | |
| 2013/0242359 | A1 | 9/2013 | Heishi et al. | |
| 2013/0270763 | A1 | 10/2013 | Furuhashi et al. | |
| 2013/0320611 | A1 | 12/2013 | Kubo et al. | |
| 2014/0062003 | A1 | 3/2014 | Niitsuma et al. | |
| 2014/0062005 | A1 | 3/2014 | Suzuki et al. | |
| 2014/0062016 | A1 | 3/2014 | Watanabe et al. | |
| 2014/0145395 | A1 | 5/2014 | Takano et al. | |
| 2014/0159301 | A1 | 6/2014 | Suzuki et al. | |
| 2014/0203501 | A1 | 7/2014 | Hoshino et al. | |
| 2015/0048566 | A1 | 2/2015 | Utagawa et al. | |
| 2015/0123342 | A1 | 5/2015 | Furuhashi et al. | |
| 2015/0166280 | A1 | 6/2015 | Hino et al. | |
| 2015/0353315 | A1 | 12/2015 | Suzuki et al. | |
| 2016/0016740 | A1 | 1/2016 | Niikura et al. | |
| 2016/0107853 | A1 | 4/2016 | Hashimoto et al. | |
| 2016/0107854 | A1 | 4/2016 | Hashimoto et al. | |
| 2016/0122144 | A1 | 5/2016 | Fukumoto et al. | |
| 2016/0185552 | A1 | 6/2016 | Hoshino et al. | |
| 2016/0272443 | A1 | 9/2016 | Seto et al. | |
| 2017/0081140 | A1 | 3/2017 | Fukumoto et al. | |

FOREIGN PATENT DOCUMENTS

| | | |
|---|---|---|
| JP | 2012-030965 | 2/2012 |
| JP | 2017-119567 | 7/2017 |

* cited by examiner

SHEET SORTING DEVICE, POST-PROCESSING APPARATUS, AND IMAGE FORMING SYSTEM

CROSS-REFERENCE TO RELATED APPLICATION

This patent application is based on and claims priority pursuant to 35 U.S.C. § 119(a) to Japanese Patent Application No. 2019-062839, filed on Mar. 28, 2019, in the Japan Patent Office, the entire disclosure of which is hereby incorporated by reference herein.

BACKGROUND

Technical Field

This disclosure relates to a sheet sorting device, a post-processing apparatus, and an image forming system.

Background Art

Various types of known image forming apparatuses such as copiers (having not only a printing function of printing image data but also a coping function and a facsimile function) include a plurality of sheet feed trays, a plurality of sheet ejection trays, or both vertically disposed to the housing of each image forming apparatus.

In addition, various types of known image forming apparatuses have a technique for a sheet ejection system to perform a print job handling a large number of sheets by ejecting the large number of sheets alternately to a plurality of sheet ejection trays so that the large number of sheets is sequentially printed without stopping the print job of the image forming apparatus.

SUMMARY

At least one aspect of this disclosure provides a novel sheet sorting device including a plurality of trays, a tray shifter, a tray stop position detector, and circuitry. The plurality of trays is disposed in multiple stages in a vertical direction and configured to stack a sheet from an image forming apparatus. The tray shifter is configured to move the plurality of trays separately in a tray shift direction perpendicular to a sheet conveyance direction in which the sheet is conveyed. The tray stop position detector is configured to detect respective stop positions of the plurality of trays separately. The circuitry is configured cause the tray shifter to move the plurality of trays to respective home positions in an initial operation, at least one tray of the plurality of trays having a home position opposite to a home position of another tray of the plurality of trays in the tray shift direction. The circuitry is configured to, while the plurality of trays moves at a same time in the initial operation, cause the tray shifter to move the at least one tray and said another tray in directions opposite to each other.

Further, at least one aspect of this disclosure provides an improved post-processing apparatus including the above-described sheet sorting device and a sheet processing device configured to perform a post-processing to the sheet.

Further, at least one aspect of this disclosure provides an improved image forming system including an image forming apparatus configured to form an image on a sheet and the above-described sheet sorting device configured to sort the sheet on which the image is formed by the image forming apparatus.

Further, at least one aspect of this disclosure provides a novel post-processing apparatus including a plurality of trays, a tray shifter, a tray stop position detector, and circuitry. The plurality of trays is disposed in multiple stages in a vertical direction and configured to stack a sheet from an image forming apparatus. The tray shifter is configured to move the plurality of trays separately in a tray shift direction perpendicular to a sheet conveyance direction in which the sheet is conveyed. The tray stop position detector is configured to detect respective stop positions of the plurality of trays separately. The circuitry is configured cause the tray shifter to move the plurality of trays to respective home positions in an initial operation, at least one tray of the plurality of trays having a home position opposite to a home position of another tray of the plurality of trays in the tray shift direction. The circuitry is configured to, while the plurality of trays moves at a same time in the initial operation, cause the tray shifter to move the at least one tray and said another tray in directions opposite to each other.

Further, at least one aspect of this disclosure provides an improved image forming system including an image forming apparatus configured to form an image on a sheet and the above-described post-processing apparatus configured to perform the post-processing to the sheet on which the image is formed by the image forming apparatus.

Further, at least one aspect of this disclosure provides a novel image forming system including and an image forming apparatus, a sheet sorting device, and circuitry. The image forming apparatus is configured to form an image on a sheet. The sheet sorting device is configured to sort the sheet on which the image is formed by the image forming apparatus and includes a plurality of trays, a tray shifter, and a tray stop position detector. The plurality of trays is disposed in multiple stages in a vertical direction and configured to stack a sheet from an image forming apparatus. The tray shifter is configured to move the plurality of trays separately in a tray shift direction perpendicular to a sheet conveyance direction in which the sheet is conveyed. The tray stop position detector is configured to detect respective stop positions of the plurality of trays separately. The circuitry is configured to cause the tray shifter to move the plurality of trays to respective home positions in an initial operation, at least one tray of the plurality of trays having a home position opposite to a home position of another tray of the plurality of trays in the tray shift direction. The circuitry is configured to, while the plurality of trays moves at a same time in the initial operation, cause the tray shifter to move the at least one tray and said another tray in directions opposite to each other.

Further, at least one aspect of this disclosure provides a novel image forming system including and an image forming apparatus, a post-processing apparatus, and circuitry. The image forming apparatus is configured to form an image on a sheet. The post-processing apparatus is configured to configured to perform the post-processing to the sheet on which the image is formed by the image forming apparatus and includes a plurality of trays, a tray shifter, and a tray stop position detector. The plurality of trays is disposed in multiple stages in a vertical direction and configured to stack a sheet from an image forming apparatus. The tray shifter is configured to move the plurality of trays separately in a tray shift direction perpendicular to a sheet conveyance direction in which the sheet is conveyed. The tray stop position detector is configured to detect respective stop positions of the plurality of trays separately. The circuitry is configured to cause the tray shifter to move the plurality of trays to respective home positions in an initial operation, at least one tray of the plurality of trays having a home position opposite to a home position of another tray of the plurality of trays in the tray shift direction. The circuitry is configured to, while the plurality of trays moves at a same time in the initial operation, cause the tray shifter to move the at least one tray and said another tray in directions opposite to each other.

BRIEF DESCRIPTION OF THE SEVERAL VIEWS OF THE DRAWINGS

An exemplary embodiment of this disclosure will be described in detail based on the following figured, wherein.

Figure 1:
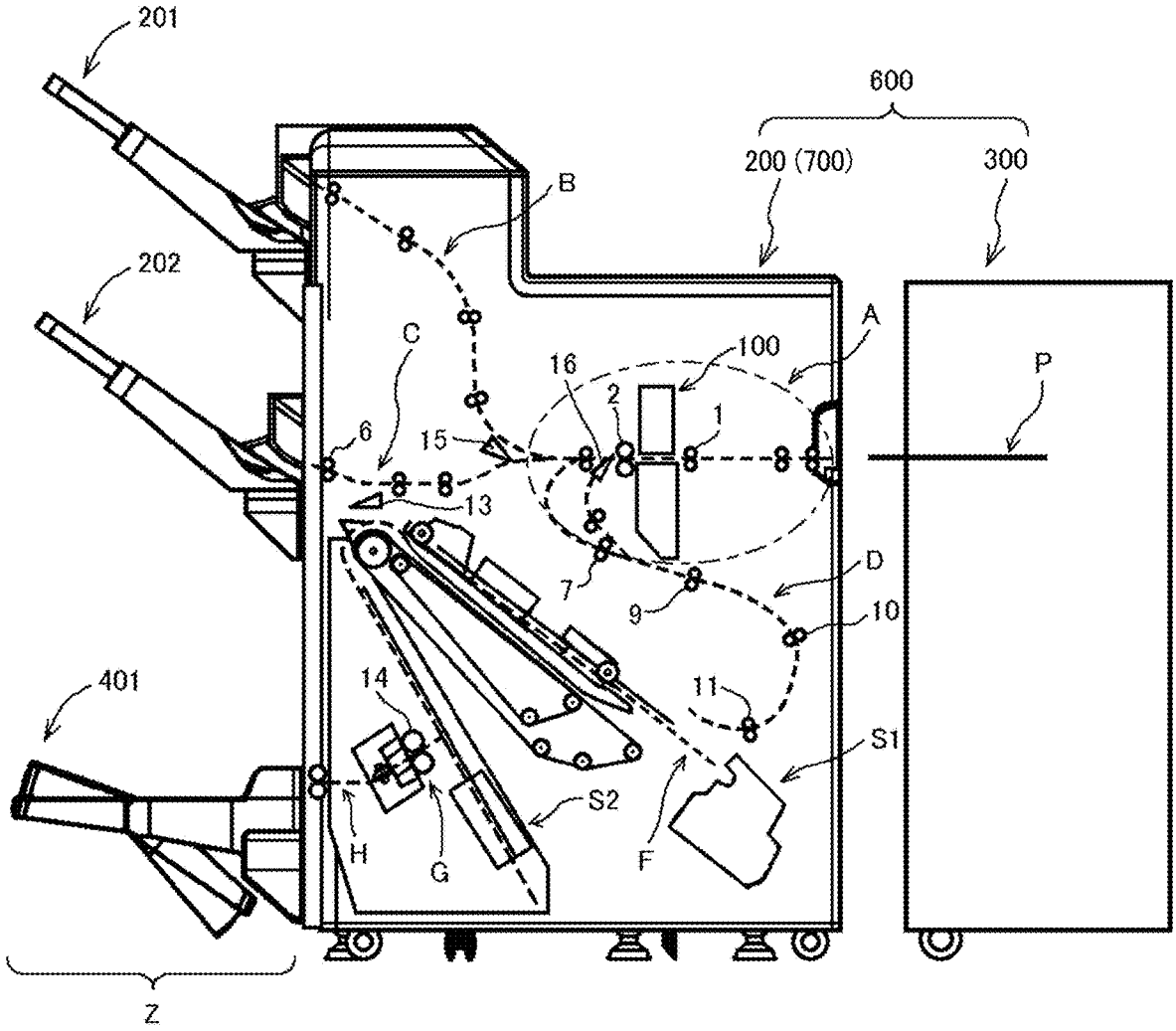
FIG. 1 is a diagram illustrating a schematic configuration of an image forming system according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Descriptions are given of an embodiment applicable to a sheet sorting device, a post-processing apparatus, and an image forming apparatus, with reference to the following figures.

FIG. 1 is a diagram illustrating a schematic configuration of an image forming system 600 according to an embodiment of this disclosure.

As illustrated in FIG. 1, the image forming system 600 includes a post-processing apparatus 200 and an image forming apparatus 300. The post-processing apparatus 200 functions as a sheet processing device. The image forming apparatus 300 supplies a sheet P that functions as a sheet-type recording medium, to the post-processing apparatus 200 after image formation. The image forming apparatus 300 is, for example, a copier or a printer.

The image forming apparatus 300 according to the present embodiment is an electrophotographic image forming apparatus that includes image processing circuitry, at least one photoconductor, an optical writing device, a developing device, a transfer device, and a fixing device.

In a case in which the image forming apparatus 300 is a copier, the image processing circuitry converts image data read by a scanner into printable image data and outputs the converted image data to the optical writing device. Similarly with image data input from an external device such as a personal computer, the image processing circuitry converts the image data from the external device and outputs the converted image data to the optical writing device.

The optical writing device optically writes the image data onto a photoconductor based on an image signal output from the image processing circuitry so as to form an electrostatic latent image on the surface of the photoconductor. The developing device develops the electrostatic latent image formed on the surface of the photoconductor by the optical writing device, into a visible image with toner (i.e., a toner image). The transfer device transfers the toner image on the surface of the photoconductor visualized by the developing device, onto the surface of the sheet P. The fixing device fixes the toner image transferred on the sheet P, to the sheet P.

The sheet P to which the toner image is fixed is conveyed from the image forming apparatus 300 to the post-processing apparatus 200, where desired post-processing operation are performed.

As described above, the image forming apparatus 300 according to the present embodiment is an electrophotographic image forming apparatus. However, the configuration of the image forming apparatus is not limited to the image forming apparatus 300 according to the present embodiment. For example, this disclosure is applicable to an inkjet image forming apparatus, a thermal image forming apparatus, and any other known image forming apparatus, and such an image forming apparatus may be the image forming apparatus 300 and be operable together with the post-processing apparatus 200.

As illustrated in FIG. 1, the post-processing apparatus 200 is disposed (attached) on a side face of the image forming apparatus 300. After being ejected from the image forming apparatus 300, the sheet P is guided and conveyed to the post-processing apparatus 200.

The post-processing apparatus 200 according to the present embodiment performs, with respect to the sheet P, various processes such as a punching process (using a punch unit 100), an end stitching process (using an end stitching stapler S1), a saddle stitching process (using a saddle stapling stapler S2), and a center folding process (using a pair of sheet folding rollers 14).

The post-processing apparatus 200 has a sheet entering portion A that is a portion to which the sheet P ejected from the image forming apparatus 300 is first conveyed. The sheet entering portion A has a single sheet post-processing unit to perform a post-processing for each sheet that passes the sheet entering portion A. In the present embodiment, a punching unit 100 functions as the single sheet post-processing unit.

A first sheet ejection passage B is provided higher than the sheet entering portion A. The first sheet ejection passage B guides the sheet P to a shift tray 201. A second sheet ejection passage C is provided on a substantially horizontal side of the sheet entering portion A. The second sheet ejection passage C guides the sheet P to a shift tray 202. In addition, an end stitching process passage D is provided below the sheet entering portion A of the post-processing apparatus 200, so that the sheet P is guided to an end stitching process tray F through the end stitching process passage D. In the end stitching process tray F, the sheet P is aligned and stapled with other sheets P conveyed or to be conveyed via the end stitching process passage D.

The sheet entering portion A is a passage upstream from the first sheet ejection passage B, the second sheet ejection passage C, and the end stitching process passage D in a sheet conveyance direction in which the sheet P is conveyed. Each sheet P that is conveyed from the image forming apparatus 300 shares the sheet entering portion A with the other sheets P to enter the post-processing apparatus 200. The sheet entering portion A is provided with a sheet entrance sensor that detects passage of the sheet P conveyed from the image forming apparatus 300. The sheet entering portion A is further provided with a pair of sheet entrance rollers 1, the punching unit 100, and a pair of pre-branching rollers 2 disposed, in this order, downstream from the sheet entrance sensor in the sheet conveyance direction. Further, two branch claws (that is, a first branch claw 15 and a second branch claw 16) are disposed downstream from the pair of pre-branching rollers 2 of the sheet entering portion A.

Each of the first branch claw 15 and the second branch claw 16 is retained by a biasing member such as a spring, in a state as illustrated in FIG. 1. To be more specific, the first branch claw 15 is biased with the edge facing down and the second branch claw 16 is biased with the edge facing up. The first branch claw 15 and the second branch claw 16 are connected to respective solenoids.

By turning on each solenoid, the edges of the first branch claw 15 and the second branch claw 16 are displaced from the state illustrated in FIG. 1, so that each of the first branch claw 15 and the second branch claw 16 switches the direction of the sheet conveyance passage of the sheet P when the sheet P passes the respective positions of the first branch claw 15 and the second branch claw 16.

In the post-processing apparatus 200, by changing the combination of the tuning on and off of each solenoid of the first branch claw 15 and the second branch claw 16, the sheet conveyance passage of the sheet P after passing the sheet entering portion A is switched to one of the first sheet ejection passage B, the second sheet ejection passage C, and the end stitching process passage D.

In an extreme downstream side of the sheet conveyance passage of the sheet P in the sheet conveyance direction, after passing the sheet entering portion A, the first sheet ejection passage B, and the second sheet ejection passage C, the sheet P is conveyed to a sheet ejection shift tray portion that includes the shift trays 201 and 202. The sheet ejection shift tray portion functions as a sheet stacker that includes a tray shifter 400 and a tray elevator. In the tray shifter 400, the shift trays 201 and 202 reciprocally move in a tray shift direction (in other words, a sheet width direction) that is a direction perpendicular to the sheet conveyance direction of the sheet P. In the tray elevator, the shift trays 201 and 202 move vertically.

In the end stitching process passage D, a first pair of end stitching passage rollers 7, a sheet guiding claw, a pre-stacking sensor, a second pair of end stitching passage rollers 9, and a third pair of end stitching passage rollers 10 are disposed, in this order, from upstream in the sheet conveyance direction.

Further, as illustrated in FIG. 1, the end stitching process passage D has a curved portion located downstream from the third pair of end stitching passage rollers in the sheet conveyance direction. A curved entrance sheet detection sensor is disposed at the entrance of the curved portion of the end stitching process passage D, to detect whether the sheet P has passed the position of the curved entrance sheet detection sensor. Further, a pair of end stitching transfer rollers 11 is disposed at the exit of the curved portion of the end stitching process passage D, to transfer the sheet P that has passed the end stitching process passage D to the end stitching process tray F.

While the end stitching process is performed in the end stitching process tray F of the post-processing apparatus 200, a subsequent sheet P that is conveyed after the sheet P currently in the end stitching process is not conveyed to the end stitching process tray F. Here, in order not to feed a new sheet (such as the above-described subsequent sheet P) to the end stitching process tray F while the end stitching process is performed in the end stitching process tray F, if the transfer of the new sheet P from the image forming apparatus 300 to the post-processing apparatus 200 is stopped, the productivity of the whole image forming system 600 decreases.

Therefore, in order to save the time for the end stitching process while maintaining the productivity of the whole image forming system 600, a pre-stack process is performed. The pre-stack process is performed to save a virtual time by temporarily stopping the sheet P and then conveying a plurality of sheets P at the same time to the end stitching process tray F.

After the sheet P is guided to the end stitching process tray F via the sheet entering portion A and the end stitching process passage D, the post processing including alignment and stapling is performed to the sheet P in the end stitching process tray F. Further, a sheet bundle branching guide 13 guides the sheet P to a sheet conveyance passage toward the shift tray 202 or a sheet conveyance passage toward a sheet stacking tray 401 of a saddle stitching stacker portion Z.

When the sheet P is sorted to the sheet conveyance passage toward the shift tray 202, the sheet P is guided near an area upstream from a second sheet ejection sensor in the second sheet ejection passage C in the sheet conveyance direction. In the area, similar to the sheet P to pass the second sheet ejection passage C, the sheet P is ejected by a pair of second sheet ejection rollers 6 to the shift tray 202.

On the other hand, when the sheet P is sorted to the sheet conveyance passage toward the sheet stacking tray 401, the sheet P transport path toward the sheet stacking tray 401, the sheet P is conveyed to a saddle stitching and saddle folding portion G, where the sheet P receives a post processing such as a saddle stitching process or a saddle folding process. After receiving the post processing such as the saddle folding process, the sheet P passes a sheet conveying path H to the sheet stacking tray 401.

Note that this disclosure is limited to the image forming system 600 including the image forming apparatus 300 and the post-processing apparatus 200. For example, this disclosure may be applicable to a sheet processing unit of an image forming system including an image forming apparatus to form an image on the sheet P and the sheet processing unit to perform, for example, a sheet folding operation to the sheet P.

Further, this disclosure may be applicable to a sheet sorting device 700 instead of the post-processing apparatus 200. The sheet sorting device 700 sorts and stacks ejected sheets to the shift trays 201 and 202. The sheet sorting device 700 is included in the post-processing apparatus 200. The sheet sorting device 700 has a configuration basically identical to the post-processing apparatus 200 but does not include sheet processing units performing given processes to the sheet P (for example, the punching unit 100 that performs the punching process, the end stitching stapler S1 that performs the end stitching process, and the pair of sheet folding rollers 14 that performs the center folding process).

Figure 2:
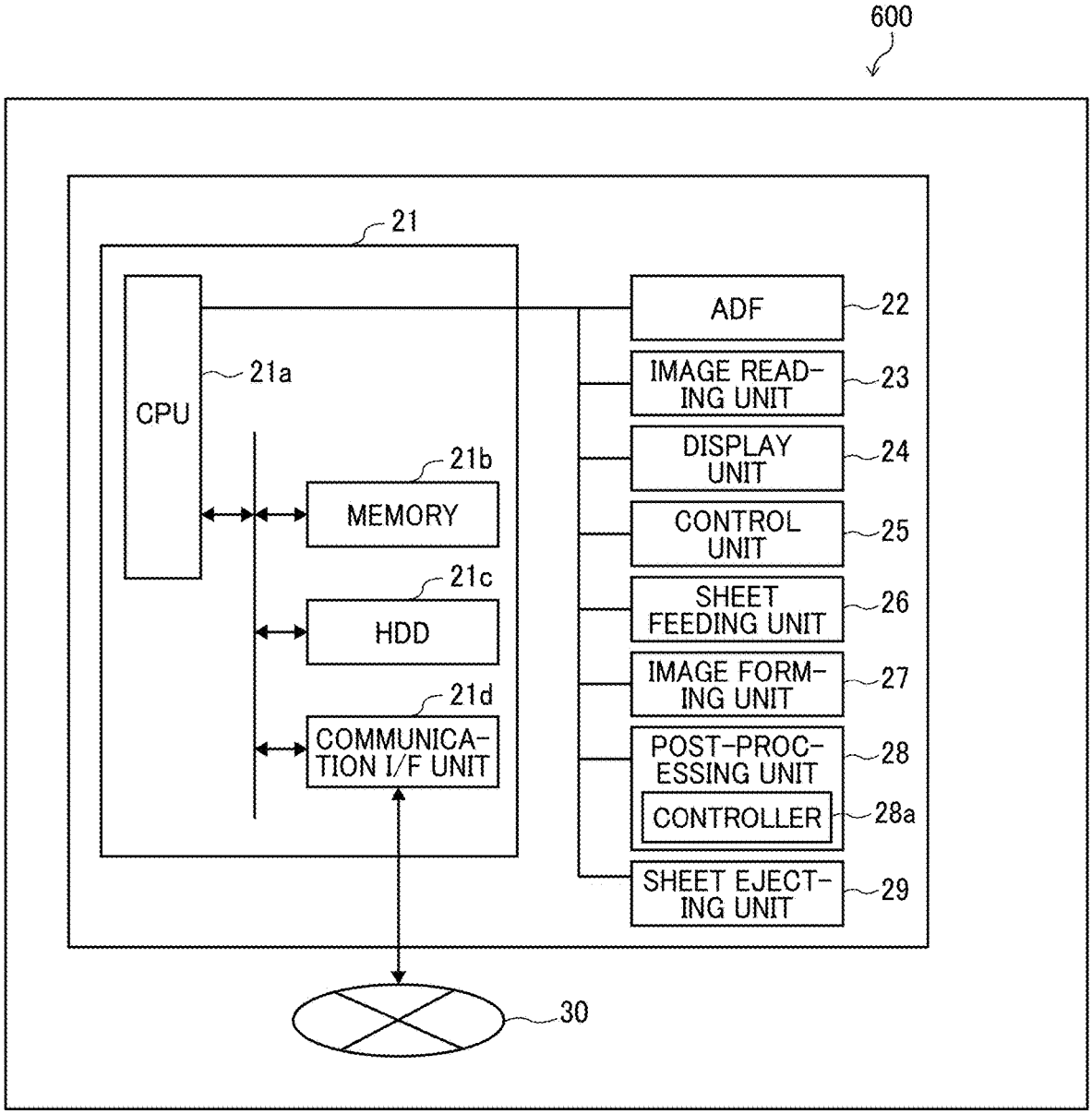
FIG. 2 is a block diagram illustrating an example of a functional configuration of the image forming system of FIG. 1.

FIG. 2 is a block diagram showing an example of a functional configuration in the image forming system 600 of FIG. 1.

The image forming system 600 includes a controller 21, an automatic document feeder (ADF) 22, an image reading unit 23, a display unit 24, a control unit 25, a sheet feeding unit 26, an image forming unit 27, a post-processing unit 28, and a sheet ejecting unit 29. The post-processing unit 28 corresponds to the post-processing apparatus 200 and the sheet sorting device 700, and a controller 28*a* is provided in each of the post-processing apparatus 200 and the sheet sorting device 700 to cause the post-processing apparatus 200 and the sheet sorting device 700 to move the sheet trays 201 and 202.

The controller 21 that functions as circuitry to control respective units in the image forming system 600 and includes a central processing unit (CPU) 21*a*, a memory 21*b* such as a random access memory (RAM) and a read only memory (ROM), a hard disk drive (HDD) 21*c*, and a communication interface (I/F) unit 21*d*. These units are connected via a bus.

The CPU 21*a* performs control of these units and image processing. The RAM temporarily stores results of various data read by the HDD 21*c*, the image reading unit 23, and the communication I/F unit 21*d*. The stored data is subjected to image processing by the CPU 21*a*, and is transferred to the HDD 21*c* or the image forming unit 27 accordingly.

The HDD 21*c* and the ROM store programs for the CPU 21*a* to control each unit, information on processing functions of the image forming system 600, a table for associating sheet information (for example, weight per sheet, sheet size, and thickness per sheet). These data are read out by the CPU 21*a* accordingly and are executed on the RAM.

The communication I/F unit 21*d* establishes a connection with a device connected via communication network 30 and transmits and receives data.

The controller 21 analyzes a print job received from an information device connected via the communication network 30 and refers to a table stored in the HDD 21*c* or the ROM to optimize the control inside the system configuration corresponding to the sheet type specified in the print job.

Figure 3B:
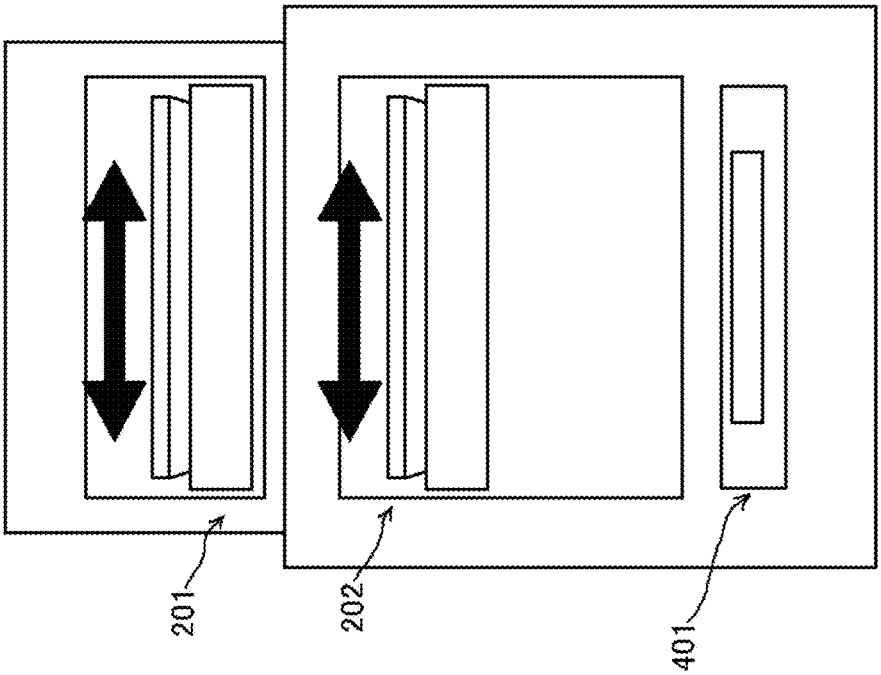
FIG. 3B is a side view illustrating the post-processing apparatus viewed from a direction indicated by arrow DA.
Figure 3A:
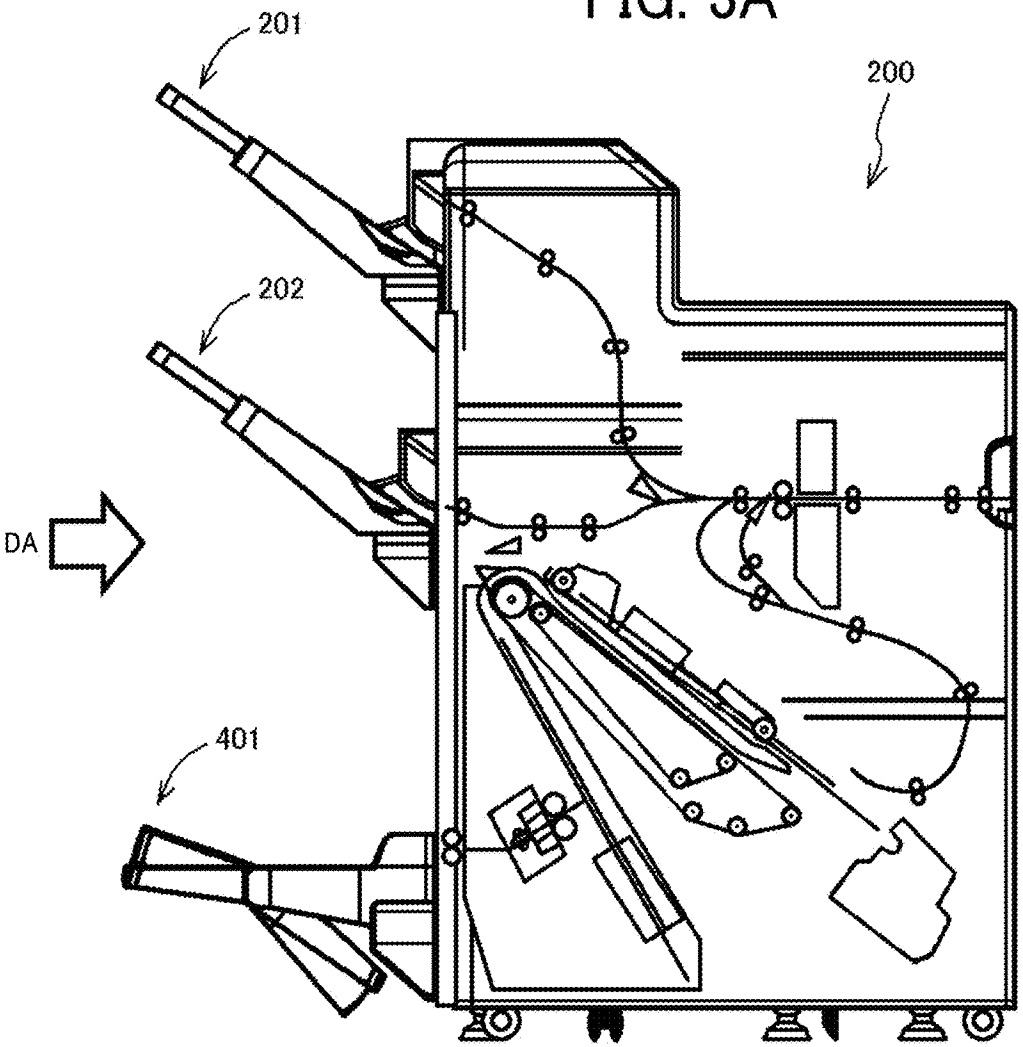
FIG. 3A is a front view illustrating a post-processing apparatus according to an embodiment of this disclosure.

FIG. 3A is a front view illustrating the post-processing apparatus 200 according to an embodiment of this disclosure. FIG. 3B is a side view illustrating the post-processing apparatus 200, viewed from a direction indicated by arrow DA.

As illustrated in FIG. 3B, the shift trays 201 and 202 of the post-processing apparatus 200 reciprocally move in a direction (that is, the tray shift direction) perpendicular to the sheet conveyance direction (that is, a sheet ejection direction) of the sheet P. The movement (operation) of the shift trays 201 and 202 is referred to as a "tray shifting operation".

Figure 4B:
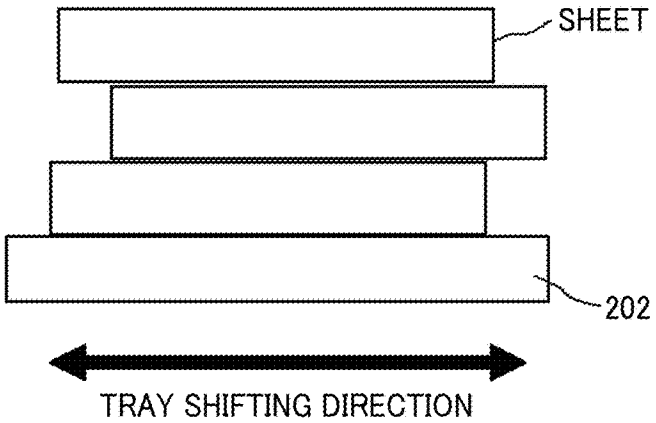
FIG. 4B is a diagram illustrating a sheet stacking state in which sheets are ejected on a shift tray.
Figure 4A:
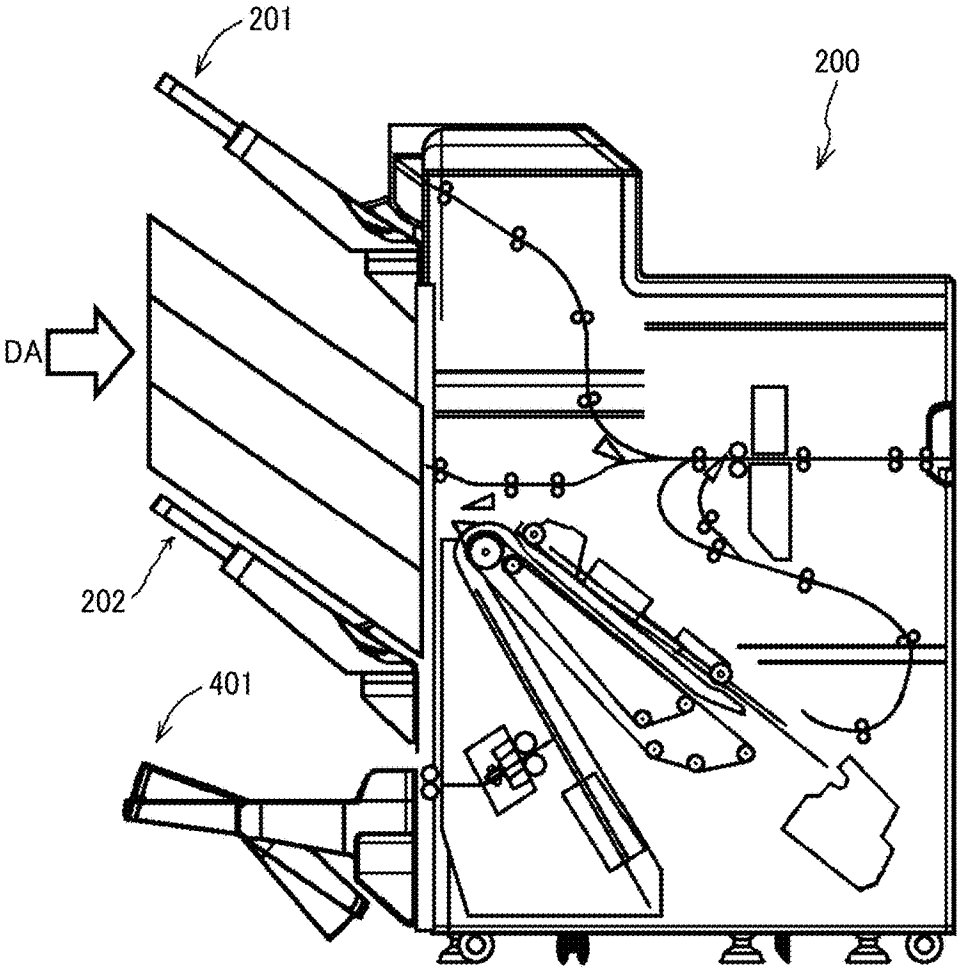
FIG. 4A is a front view illustrating the post-processing apparatus when a tray shifting operation is performed.

FIG. 4A is a front view illustrating the post-processing apparatus 200 when the tray shifting operation is performed. FIG. 4B is a diagram illustrating a sheet stacking state in which sheets are ejected on the shift tray.

As illustrated in FIGS. 4A and 4B, a description is given of a case in which the sheet P is ejected onto the shift tray 202.

The post-processing apparatus 200 moves the shift tray 202 in the tray shift direction when the number of printed sheets P previously set by the user (hereinafter, referred to as "sheets") is ejected (that is, the tray shifting operation). By repeating this operation until completion of the printing, as illustrated in FIG. 4B, the ejected sheets are stacked on the shift tray 202 after being sorted to the set number of sheets.

Although a sheet exiting portion of the post-processing apparatus 200 is fixed, the sheets are sorted and stacked on the shift tray 202. Note that the shift tray 201 has the same configuration as the shift tray 202, so that the ejected sheets are stacked on the shift tray 201 after being sorted to the set number of sheets.

Figure 5:
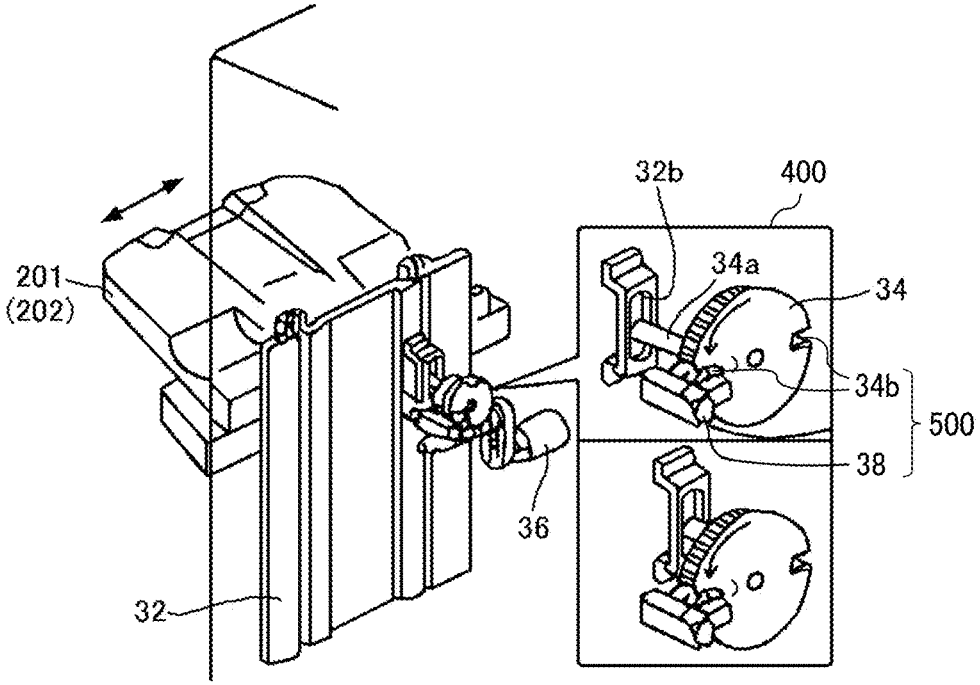
FIG. 5 is a perspective view illustrating an example of a tray shifting mechanism of the shift tray.

FIG. 5 is a perspective view illustrating an example of the tray shifting mechanism of the shift tray 201.

The shift tray 201 is coupled to an end fence 32. The end fence 32 is provided with a slot 32*b* extending in a tray elevation direction. A pin 34*a* is planted on the circumferential portion of a shift cam 34 and is fitted to the slot 32*b*. The shift cam 34 is coupled to a shift motor 36.

With this configuration, as the shift motor 36 rotates the shift cam 34, the end fence 32 engaged with the pin 34*a* of the shift cam 34 moves in the tray shift direction (in other words, a sheet width direction), and the shift tray 201 that is coupled to the end fence 32 also moves in the tray shift direction.

As described above, the shift tray 201 selectively occupies two positions, which are on the front side and the rear side of the post-processing apparatus 200. The shift sensor 38 detects two cuts 36*b* formed facing each other in the circumferential surface of the shift cam 34, so as to determine whether the shift tray 201 is at the stop position on the front side of the post-processing apparatus 200 or at the stop position on the rear side of the post-processing apparatus 200.

The shift tray 202 has the same configuration as the configuration of the shift tray 201. Therefore, as the shift motor 36 rotates the shift cam 34, the shift tray 202 moves in the tray shift direction. The stop position is determined by detecting the two cuts 36*b* formed in the shift cam 34 with the shift sensor 38.

Note that a configuration provided with the end fence 32, the shift cam 34, and the shift motor 36 is an example of the tray shifter 400 that performs the tray shifting operation on the shift trays 201 and 202 separately. In other words, the tray shifter 400 includes the end fence 32, the shift cam 34, and the shift motor 36 and moves the shift trays 201 and 202 separately. For example, the controller 21 causes the tray shifter 400 to move the shift trays 201 and 202 to the home positions in the initial operation. Further, note that a configuration provided with the cuts 36*b* formed in the shift cam 34 and the shift sensor 38 is an example of a tray stop position detector 500 that detects the respective stop positions of the shift trays 201 and 202 separately. In other words, the tray stop position detector 500 includes the cuts 36*b* and the shift sensor 38.

Next, a detailed description is given of the image forming system 600 according to this disclosure.

Generally, when the main power source of an image forming system (including a post-processing apparatus and a sheet sorting device) is turned off and then on, the image forming system performs a series of positioning operations to cause the apparatuses, devices, and mechanisms in the image forming system to move respective set positions (home positions). This series of positioning operations is referred to as an "initial operation."

The image forming system 600 illustrated in FIG. 1 performs this initial operation. Specifically, the image forming system 600 performs the initial operation to move respective mechanisms and devices of the image forming apparatus 300 and the post-processing apparatus 200 to the set positions (home positions).

The image forming system 600 performs the initial operation when: (1) the main power source is turned on; (2) the image forming system 600 returns from the sleep mode due to opening or closing the door (cover) of the image forming system 600; and (3) the image forming system 600 returns from the sleep mode due to any cause other than opening or closing the door (cover) of the image forming system 600.

However, in known configurations of multistage sheet ejection trays, an initial operation (that is, a positioning operation performed in a series of sequences when turning on a power source of a main apparatus) causes vibration to the main apparatus, resulting in generation of noise.

In order to reduce the noise level of the main apparatus, there is a known method of controlling a binding mechanism, which is attached to the main apparatus, at the initial operation. However, the above-described method is not considered for vibration and noise caused by a shift of the multistage sheet ejection tray.

Figure 6A:
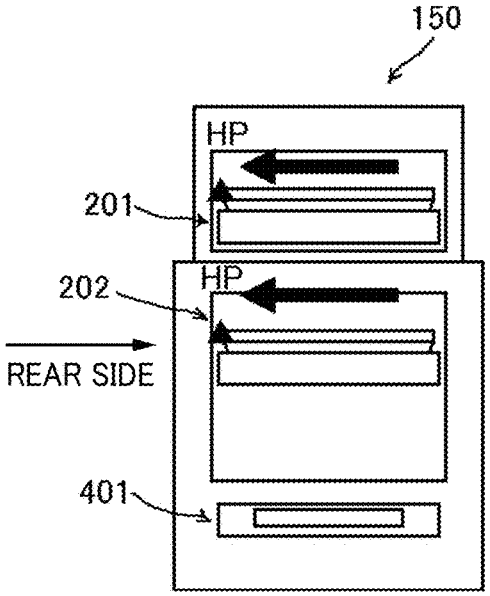
FIG. 6A is a schematic diagram illustrating an initial operation in a known post-processing apparatus in a case in which respective home positions of shift trays are on the rear side.
Figure 6B:
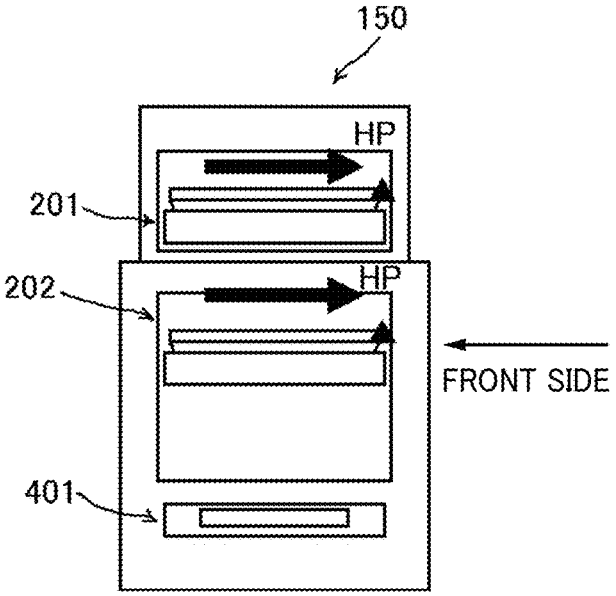
FIG. 6B is a schematic diagram illustrating the initial operation in the known post-processing apparatus in a case in which respective home positions of the shift trays are on the front side.

FIGS. 6A and 6B are schematic diagrams illustrating the initial operation performed in a known post-processing apparatus 150.

Specifically, FIG. 6A illustrates the known post-processing apparatus 150 having the shift trays 201 and 202 with respective home positions on the rear side and FIG. 6B illustrates the known post-processing apparatus 150 having the shift trays 201 and 202 with the respective home positions on the front side. That is, in the known post-processing apparatus 150, the home positions of the shift trays 201 and 202 are both disposed on the rear side as illustrated in FIG. 6A or on the front side as illustrated in FIG. 6B. Then, the known post-processing apparatus 150 moves the shift trays 201 and 202 to the respective home positions in the initial operation.

However, when the shift trays 201 and 202 are moved in the same direction, force (shock) generated when the shift trays 201 and 202 are moved and stopped concentrates on a specific portion of the known post-processing apparatus 150, so that it is likely that vibration increases of the known post-processing apparatus 150 increases.

Figure 7:
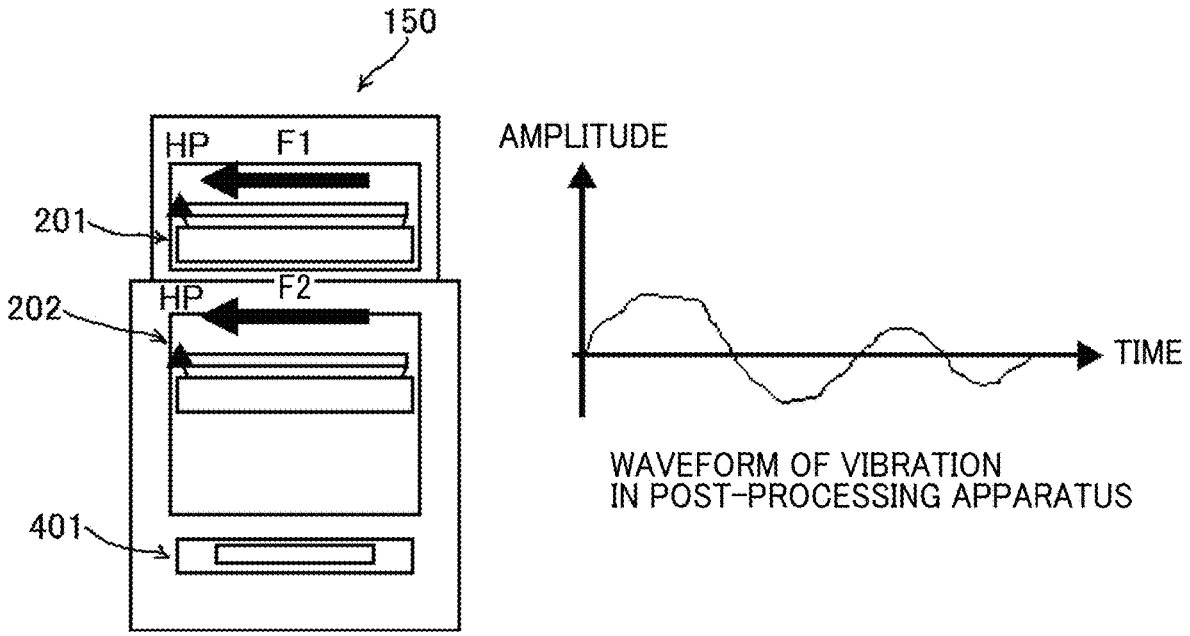
FIG. 7 is a diagram for explaining vibration generated in the known post-processing apparatus due to the initial operation.

FIG. 7 is a diagram for explaining vibration generated in the known post-processing apparatus 150 due to the initial operation.

In FIG. 7, force F1 acts on the known post-processing apparatus 150 due to the tray shifting operation of the shift tray 201 and force F2 acts on the known post-processing apparatus 150 due to the tray shifting operation of the shift tray 202.

As illustrated in FIG. 7, when the shift trays 201 and 202 are moved in the same direction (that is, in the left direction of FIG. 7), force F acting on the known post-processing apparatus 150 is the sum of the force F1 and the force F2 (F1+F2), and the force F concentrates on the acting portion. Since the force F1 and the force F2 act in the same direction, the vibration waveform of the force F1 and the vibration waveform of the force F2 have the same phase. Therefore, the amplitude generated on the known post-processing apparatus 150 increases. As a result, it was likely that the housing of the known post-processing apparatus 150 vibrated, thereby generating noise.

Now, a description is given of the post-processing apparatus capable of restraining vibration generated in the initial operation of the multistage sheet ejection tray and reducing the noise.

Embodiment 1

Figure 8B:
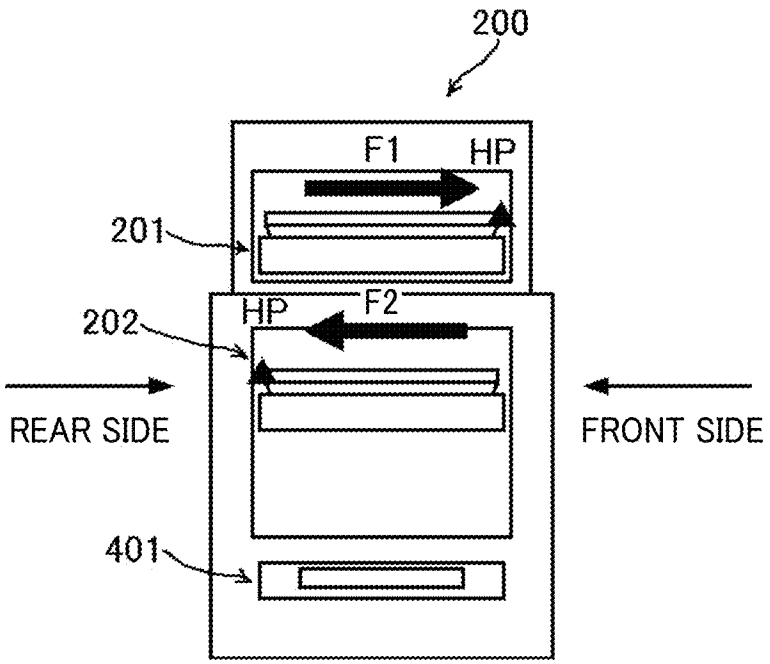
FIGS. 8A and 8B are schematic diagrams illustrating an initial operation in the post-processing apparatus according to Embodiment 1.
Figure 8A:
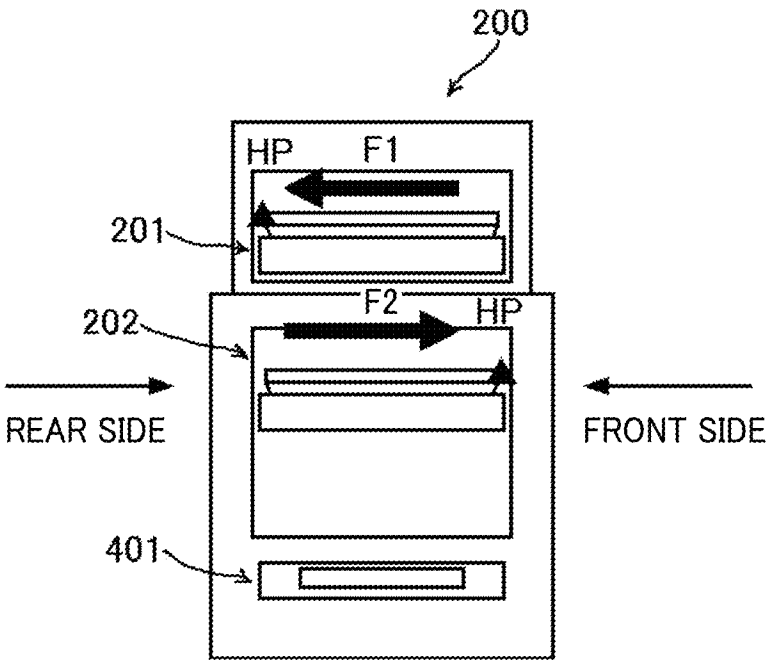

FIGS. 8A and 8B are schematic diagrams illustrating an initial operation in the post-processing apparatus according to Embodiment 1.

Specifically, FIG. 8A illustrates the post-processing apparatus 200 having the shift tray 201 with the home position on the rear side and the shift tray 202 with the home position on the front side (that is, the operation side). Then, in the initial operation, the post-processing apparatus 200 moves the shift trays 201 and 202 in directions opposite to each other.

In this case, the force F acting on the post-processing apparatus 200 is a value obtained by an equation of F1−F2 (F1≈F2) and is substantially cancelled. Therefore, the amplitude generated in the post-processing apparatus 200 is restrained, thereby reducing the noise.

Alternatively, as illustrated in FIG. 8B, the post-processing apparatus 200 may have the shift tray 201 with the home position on the front side and the shift tray 202 with the home position on the front side. Then, in the initial operation, the post-processing apparatus 200 may shift the shift trays 201 and 202 in directions opposite to each other. Also in this case, the force F acting on the post-processing apparatus 200 is a value obtained by an equation of F1−F2 (F1≈F2), and is substantially cancelled. Therefore, the amplitude generated in the post-processing apparatus 200 is restrained, thereby reducing the noise.

Figure 9:
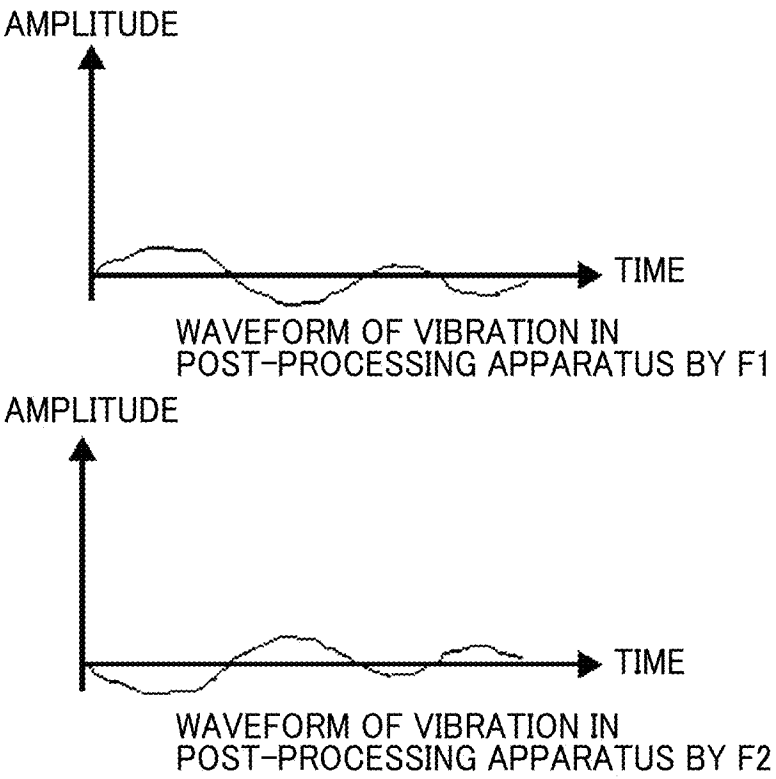
FIG. 9 is a diagram for explaining vibration generated in the post-processing apparatus due to the initial operation according to the present embodiment.
Figure 9:
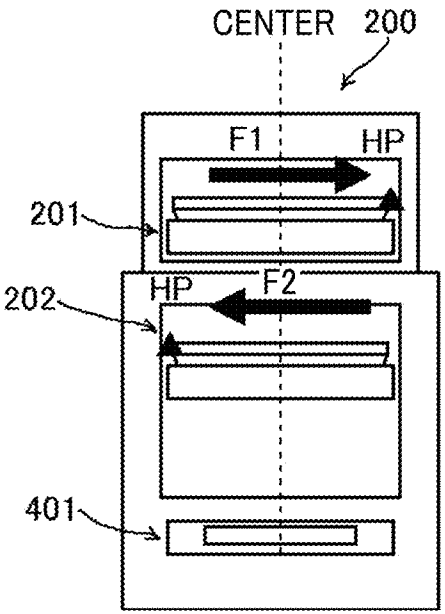

FIG. 9 is a diagram for explaining vibration generated in the post-processing apparatus due to the initial operation according to the present embodiment.

In FIG. 9, force F1 acts on the post-processing apparatus 200 due to the tray shifting operation of the shift tray 201 and force F2 acts on the post-processing apparatus 150 due to the tray shifting operation of the shift tray 202.

Since the force F1 and the force F2 act in directions opposite to each other, the amplitudes of the respective vibration waveforms are reduced and the forces F1 and F2 are dispersed. With respect to the center of the structure of the post-processing apparatus 200, the phases of vibration waveforms of the forces F1 and F2 are opposite to each other, and the amplitudes of the vibrations are canceled. Therefore, the vibration generated in the post-processing apparatus 200 is greatly restrained, and as a result, the noise in the initial operation is reduced.

In the initial operation of the present embodiment, it is preferable that the post-processing apparatus 200 completes the tray shifting operation at the same time when the shift trays 201 and 202 shift in opposite directions. In other words, it is preferable that, when the shift trays 201 and 202 shift in directions opposite to each other, the shift trays 201 and 202 complete the tray shifting operation at the same time. By stopping the shift trays 201 and 202 simultaneously, the impact at the stop is offset, and the vibration of the housing of the post-processing apparatus 200 is reduced.

Figure 10:
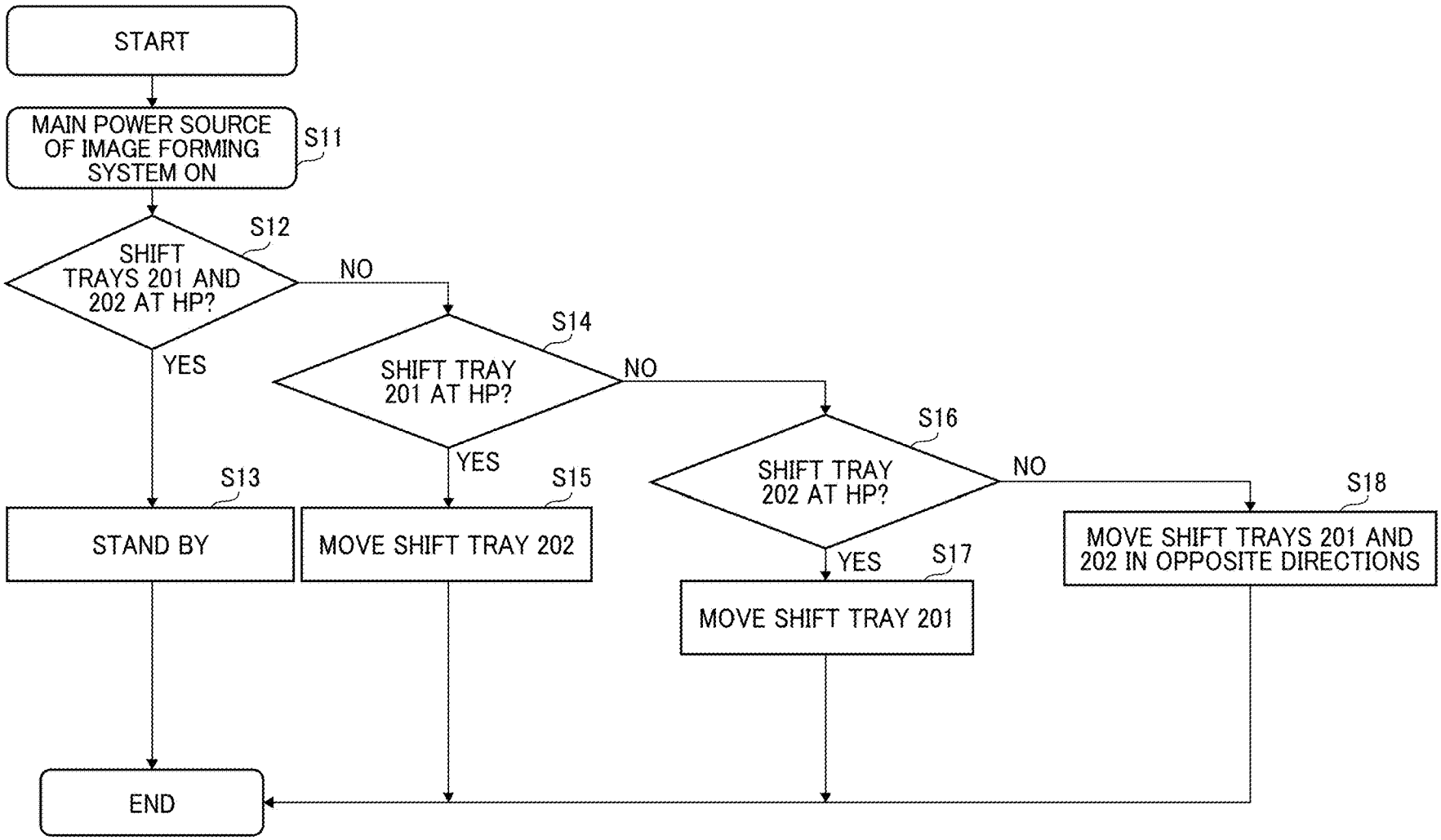
FIG. 10 is a flowchart of the tray shifting operation in the initial operation according to Embodiment 1.

FIG. 10 is a flowchart illustrating the tray shifting operation in the initial operation according to Embodiment 1.

A description is given of the initial operation that restrains vibration caused by the tray shifting operation, with reference to the flowchart of FIG. 10.

First, in step S11, the main power source of the image forming system 600 is turned on. Next, in step S12, the post-processing apparatus 200 determines whether the shift trays 201 and 202 are at the respective home positions (HPs). When the shift trays 201 and 202 are at the respective home positions (that is, YES in step S12), the process proceeds to step S13. In step S13, the post-processing apparatus 200 stands by without performing the tray shifting operation.

On the other hand, when any one of the shift trays 201 and 202 is not at the respective home positions (that is, NO in step S12), the process proceeds to step S14. In step S14, the post-processing apparatus 200 determines whether the shift tray 201 is at the home position. When the shift tray 201 is at the home position (that is, YES in step S14), the process proceeds to step S15. In step S15, the post-processing apparatus 200 moves the shift tray 202 alone. As a result, since the shift trays 201 and 202 are located at the respective home positions, the initial operation of the post-processing apparatus 200 is completed.

On the other hand, when the post-processing apparatus 200 determines that the shift tray 201 is not at the home position (that is, NO in step S14), the process proceeds to step S16.

In step S16, the post-processing apparatus 200 determines whether the shift tray 202 is at the home position. When the shift tray 202 is at the home position (that is, YES in step S16), the process proceeds to step S17. In step S17, the post-processing apparatus 200 moves the shift tray 201 alone. As a result, since the shift trays 201 and 202 are located at the respective home positions, the initial operation is completed.

On the other hand, when the shift tray 202 is not at the home position (that is, NO in step S16), the process proceeds to step S18. In step S18, the post-processing apparatus 200 moves the shift trays 201 and 202 in opposite directions to each other. As a result, since the shift trays 201 and 202 are located at the respective home positions, the initial operation of the post-processing apparatus 200 is completed.

As described above, the post-processing apparatus 200 according to the present embodiment moves either one of the shift trays 201 and 202 in the initial operation or moves the shift trays 201 and 202 in directions opposite to each other. Accordingly, vibration is restrained, and therefore noise is reduced.

Embodiment 2

Figure 11B:
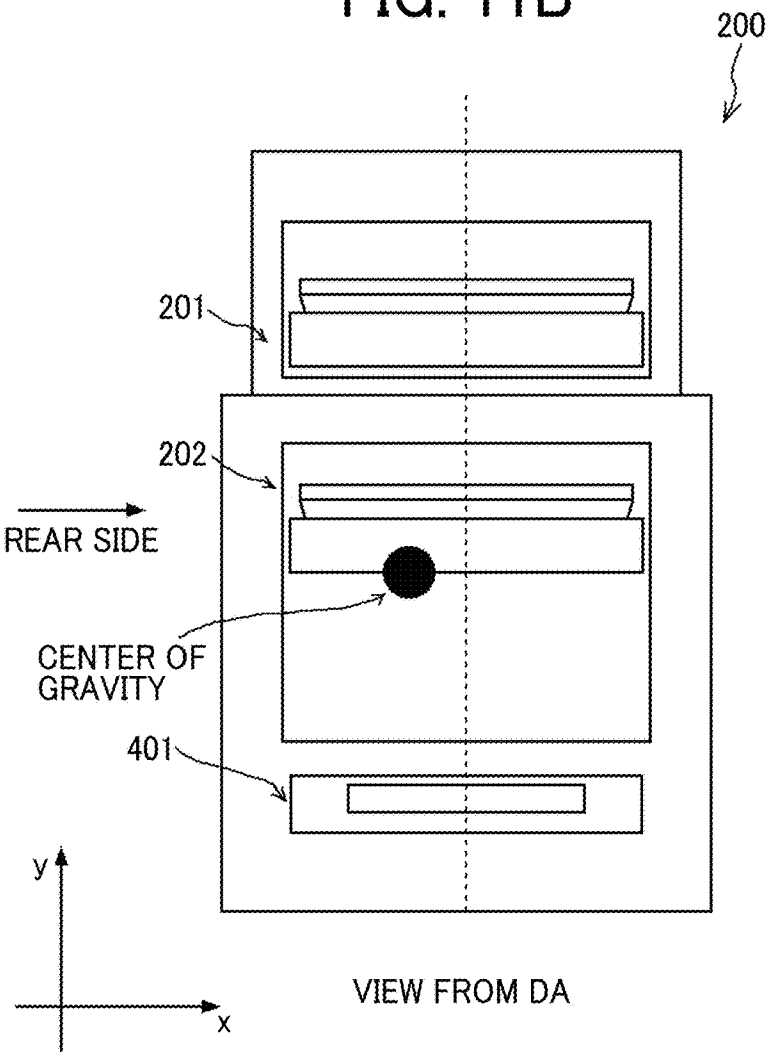
FIGS. 11A and 11B are diagrams illustrating the position of the center of gravity of the post-processing apparatus according to Embodiment 2.
Figure 11A:
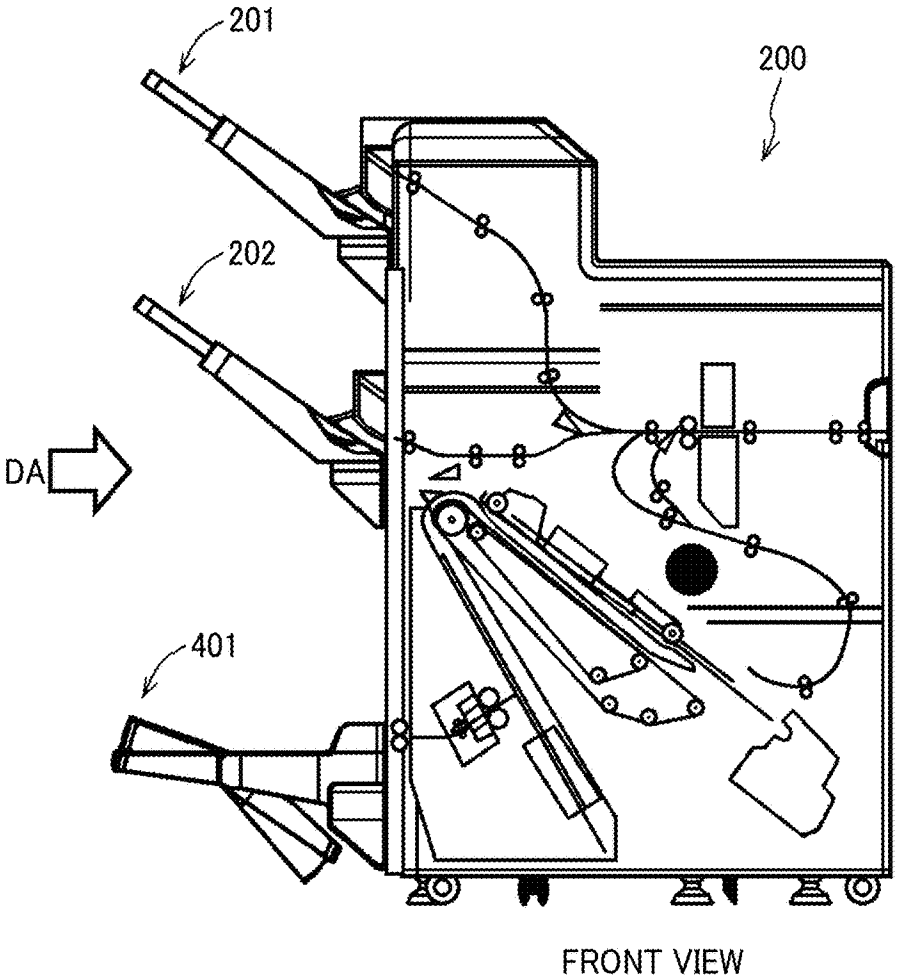
Figure 12B:
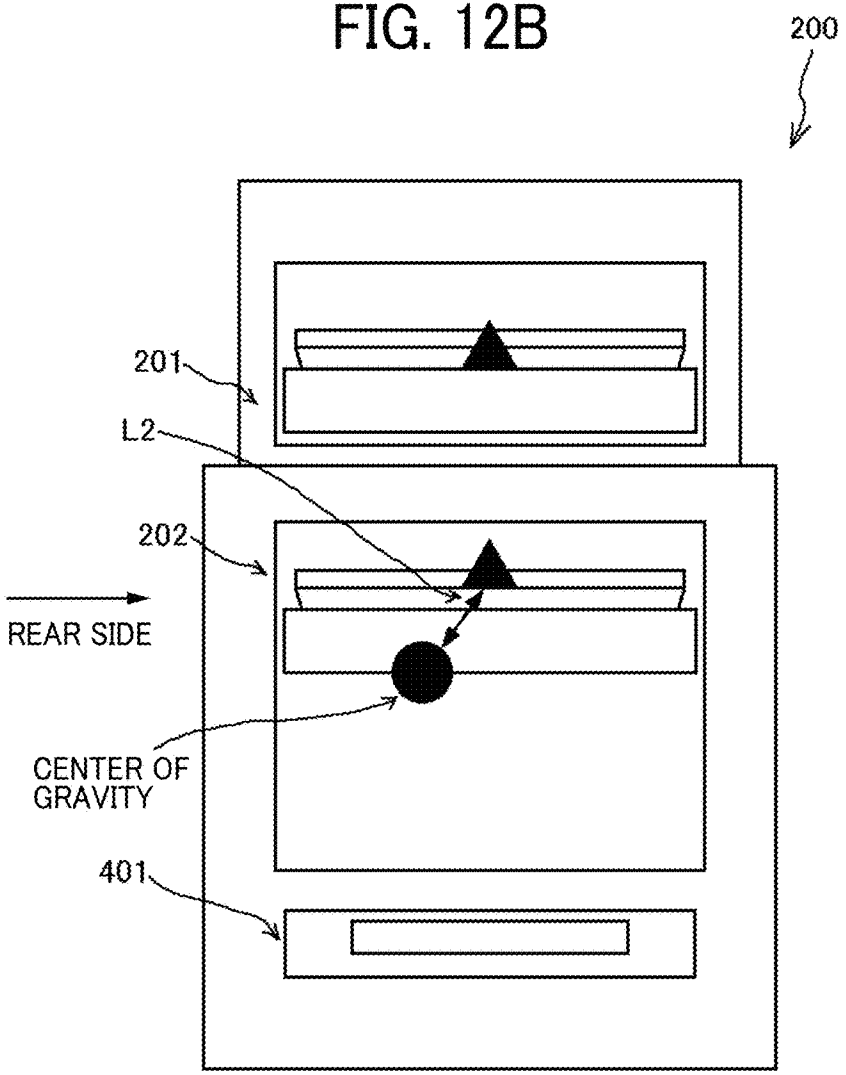
FIGS. 12A and 12B are diagrams illustrating respective distances of the shift trays from the position of the center of gravity of the post-processing apparatus.
Figure 12A:
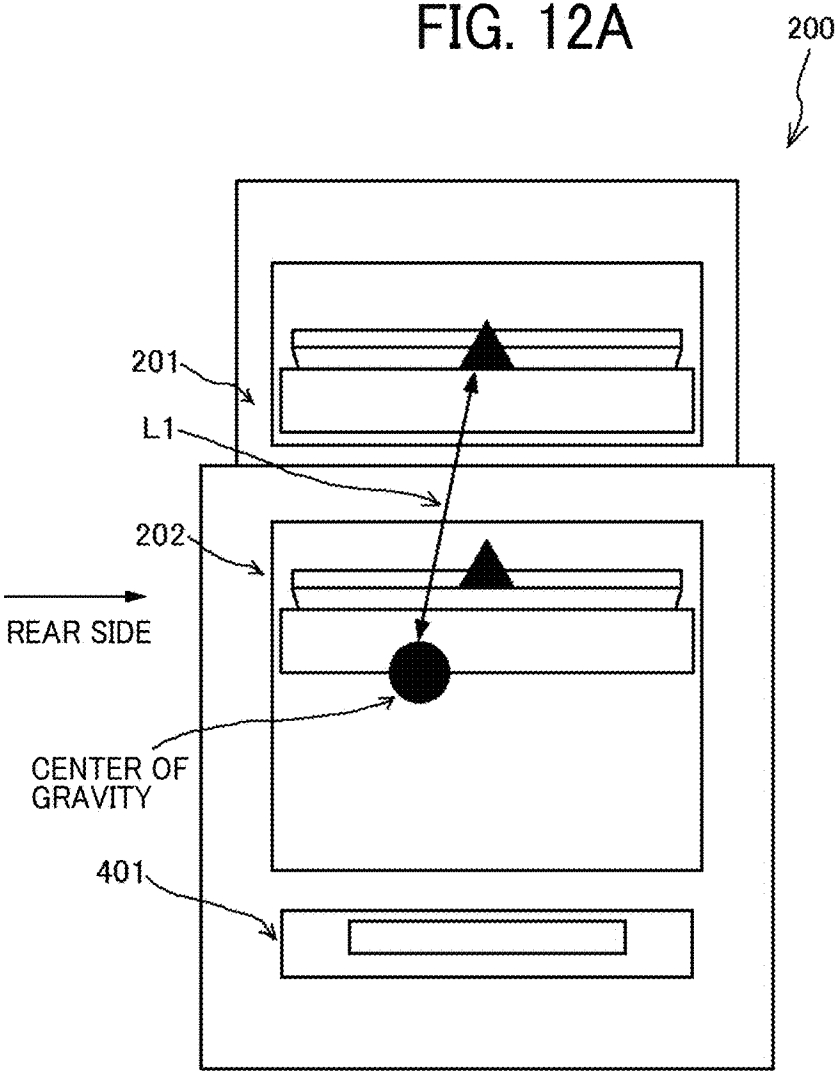

FIGS. 11A and 11B are diagrams illustrating the position of the center of gravity of the post-processing apparatus 200 according to Embodiment 2. FIGS. 12A and 12B are diagrams illustrating respective distances of the shift trays 201 and 202, from the position of the center of gravity of the post-processing apparatus 200.

As illustrated in FIG. 11B, the center of gravity of the post-processing apparatus 200 is located closer to the rear side of the post-processing apparatus 200, from the central axis (dotted line) of the post-processing apparatus 200 in the width direction (that is, a direction "x"), and is located near the shift tray 202 in the height direction (that is, a direction "y"). The reason of the above-described position of the center of gravity of the post-processing apparatus 200 is that a greater number of drive devices, such as a conveyance motor, and the substrates are disposed on the rear side of the post-processing apparatus 200 than the center axis of the post-processing apparatus 200.

As illustrated in FIGS. 12A and 12B, a distance L1 is from the center of gravity of the post-processing apparatus 200 to the shift tray 201 and a distance L2 is from the center of gravity of the post-processing apparatus 200 to the shift tray 202. The distance L1 is longer than the distance L2 (i.e., L1>L2). Therefore, at the time of the initial operation, the moment M1 of force of the shift tray 201 is greater than the moment M2 of force of the shift tray 202 (i.e., M1>M2).

Therefore, when the shift tray 201 is moved toward the center of gravity (that is, the rear side of the post-processing apparatus 200), it is likely that vibration generated when the shift tray 201 is moved toward the center of gravity is greater than vibration generated when the shift tray 202 is moved toward the center of gravity.

Accordingly, in the present embodiment, as illustrated in FIG. 8B, the home position of the shift tray 202 is set on the side close to the position of the center of gravity of the post-processing apparatus 200 (i.e., the rear side of the post-processing apparatus 200) and the home position of the shift tray 201 is set on the opposite side of the position of the center of gravity of the post-processing apparatus 200 (i.e., the front side of the post-processing apparatus 200). Then, at the time of the initial operation, the shift tray 201 is moved in the direction opposite to the position of the center of gravity of the post-processing apparatus 200 (that is, the front side of the post-processing apparatus 200) and the shift tray 202 is moved in the direction opposite to the direction of the shift tray 201 (that is, the rear side of the post-processing apparatus 200).

Consequently, the shift tray 201 having a longer distance from the position of the center of gravity of the post-processing apparatus 200 moves in the direction opposite to the position of the center of gravity of the post-processing apparatus 200 (that is, the front side of the post-processing apparatus 200), so that the inclination of the center of gravity of the post-processing apparatus 200 is restrained. Accordingly, the post-processing apparatus 200 according to the present embodiment restrains vibration due to force (impact) generated when the shift trays 201 and 202 move and stop, and therefore noise is further reduced.

Embodiment 3

The shift motor 36 illustrated in FIG. 5 is a motor for driving the tray shifting mechanism, and generally employs a stepping motor (STM). The STM varies the rotation speed of the shift motor 36 by pulse control.

In the post-processing apparatus 200 according to Embodiment 3, the shift motor 36 of the shift tray 201 rotates at a rotation speed RV1 (also referred to as a tray shifting speed RV1 of the shift tray 201) and the shift motor 36 of the shift tray 202 rotates at a rotation speed RV2 (also referred to as a tray shifting speed RV2 of the shift tray 202). The post-processing apparatus 200 controls the rotation speeds of the respective shift motors 36 to meet the relation of RV1<RV2. That is, the tray shifting speed of the shift tray 201 at the upper stage of the post-processing apparatus 200 is slower than the tray shifting speed of the shift tray 202 at the lower stage of the post-processing apparatus 200.

Thus, the force of the shift tray 201 having a large moment of force, acting on the post-processing apparatus 200, with respect to the center of gravity of the post-processing apparatus 200 is reduced, and vibration is further restrained.

Further, in the present embodiment, when the post-processing apparatus 200 moves the shift trays 201 and 202 in the directions opposite to each other, it is preferable that the tray shifting operations on the shift trays 201 and 202 are completed at the same time. The shift trays 201 and 202 are moved simultaneously by delaying the tray shifting operation of the shift tray 202 from the start time of the tray shifting operation of the shift tray 201.

Note that, in the present embodiment, the motor to drive the tray shifting mechanism is the STM but is not limited to the STM. Any motor is applied to this disclosure as long as the speed of the motor is controlled to be variable and the motor has torque to drive the tray shifting mechanism.

Figure 13:
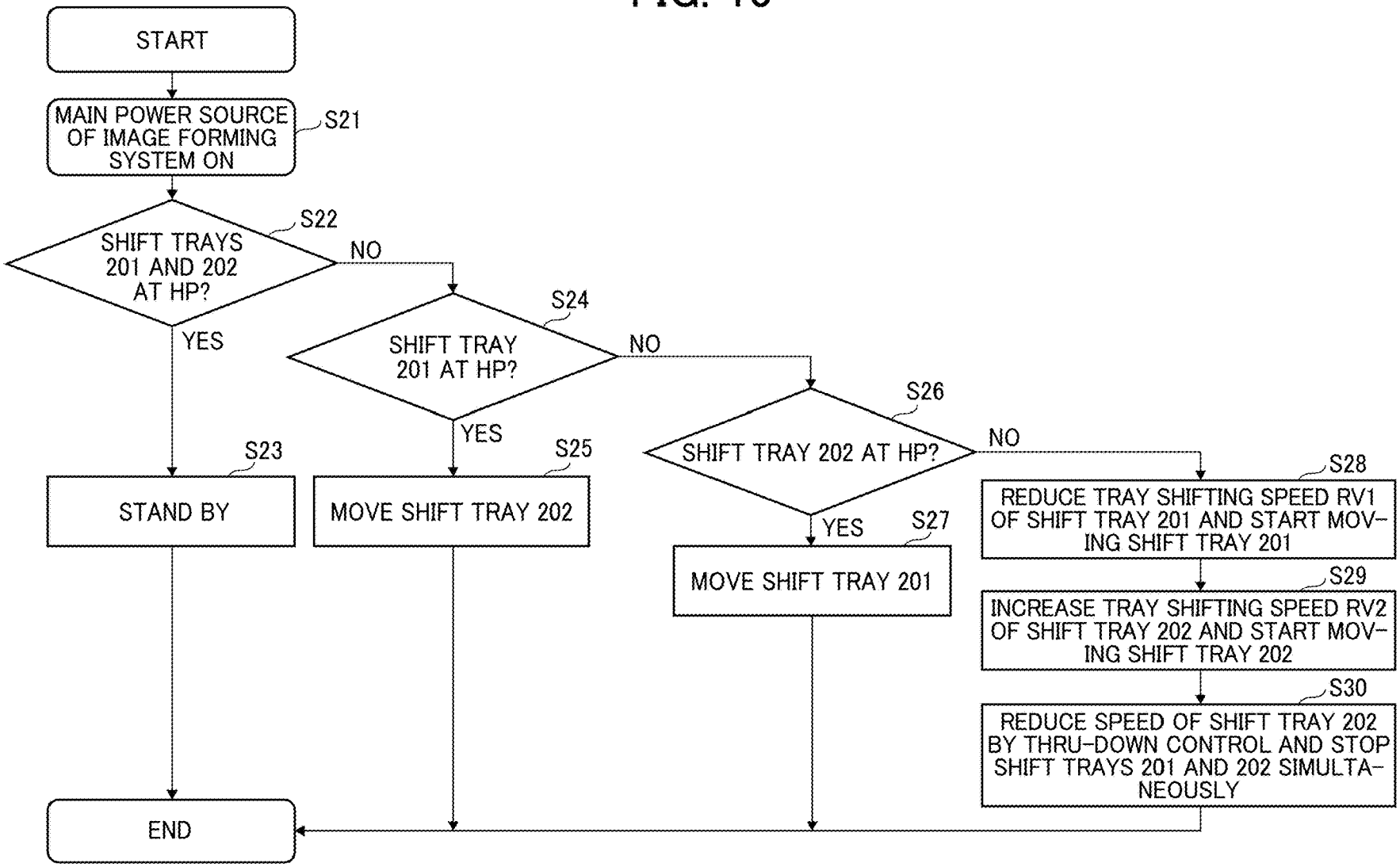
FIG. 13 is a flowchart of the tray shifting operation in an initial operation according to Embodiment 3.

FIG. 13 is a flowchart illustrating the tray shifting operation in the initial operation according to Embodiment 3.

Now, a description is given of the initial operation with a variable tray shifting speed, with reference to the flowchart of FIG. 13.

First, in step S21, the main power source of the image forming system 600 is turned on. Next, in step S22, the post-processing apparatus 200 determines whether the shift trays 201 and 202 are at the respective home positions. When the shift trays 201 and 202 are at the respective home positions (that is, YES in step S22), the process proceeds to step S23. In step S23, the post-processing apparatus 200 stands by without performing the tray shifting operation.

On the other hand, when any one of the shift trays 201 and 202 is not at the respective home positions (that is, NO in step S22), the process proceeds to step S24. In step S24, the post-processing apparatus 200 determines whether the shift tray 201 is at the home position. When the shift tray 201 is at the home position (that is, YES in step S24), the process proceeds to step S25. In step S25, the post-processing apparatus 200 moves the shift tray 202 alone. As a result, since the shift trays 201 and 202 are located at the respective home positions, the initial operation of the post-processing apparatus 200 is completed.

On the other hand, when the post-processing apparatus 200 determines that the shift tray 201 is not at the home position (that is, NO in step S24), the process proceeds to step S26.

In step S26, the post-processing apparatus 200 determines whether the shift tray 202 is at the home position. When the shift tray 202 is at the home position (that is, YES in step S26), the process proceeds to step S27. In step S27, the post-processing apparatus 200 moves the shift tray 201 alone. As a result, since the shift trays 201 and 202 are located at the respective home positions, the initial operation of the post-processing apparatus 200 is completed.

On the other hand, when the shift tray 202 is not at the home position (that is, NO in step S26), the process proceeds to step S28. In step S28, the post-processing apparatus 200 starts the tray shifting operation (starts moving the shift tray 201) by reducing the tray shifting speed RV1 of the shift tray 201. Then, the process proceeds to step S29. In step S29, the post-processing apparatus 200 starts the tray shifting operation (starts moving the shift tray 202) by increasing the tray shifting speed V2 of the shift tray 202 (RV1<RV2).

Subsequently, the process proceeds to step S30. In step S30, the post-processing apparatus 200 performs a through-down control to reduce the speed of the shift tray 202 to stop the shift trays 201 and 202 simultaneously. As a result, since the shift trays 201 and 202 are located at the respective home positions, the initial operation of the post-processing apparatus 200 is completed.

In the present embodiment, when the shift trays 201 and 202 are moved in the directions opposite to each other in the initial operation, the moving speed of the shift tray 201 on the upper side is reduced and the moving speed of the shift tray 202 on the lower side is increased. Accordingly, vibration is further restrained.

Embodiment 4

In the image forming system 600, the main power source is not always turned off after each sheet (sheets) ejected and stacked on the shift trays 201 and 202 are removed. That is, the main power source may be turned on in a state in which sheets are stacked on the shift trays 201 and 202, so as to perform the initial operation.

When the initial operation is performed in the state in which the sheets are stacked on the shift trays 201 and 202, the force (shock) acting on the post-processing apparatus 200 when the tray shifting operation is not performed (is stopped) is greater than the force acting on the post-processing apparatus 200 when the sheets are not stacked on the shift trays 201 and 202. Accordingly, vibration is likely to increase.

Therefore, the post-processing apparatus 200 of the present embodiment detects (estimates) the sheet stacking amounts of sheets on the shift trays 201 and 202 separately, and changes the tray shifting speeds of the shift trays 201 and 202 according to the sheet stacking amounts of sheets stacked on the shift trays 201 and 202.

Figure 14:
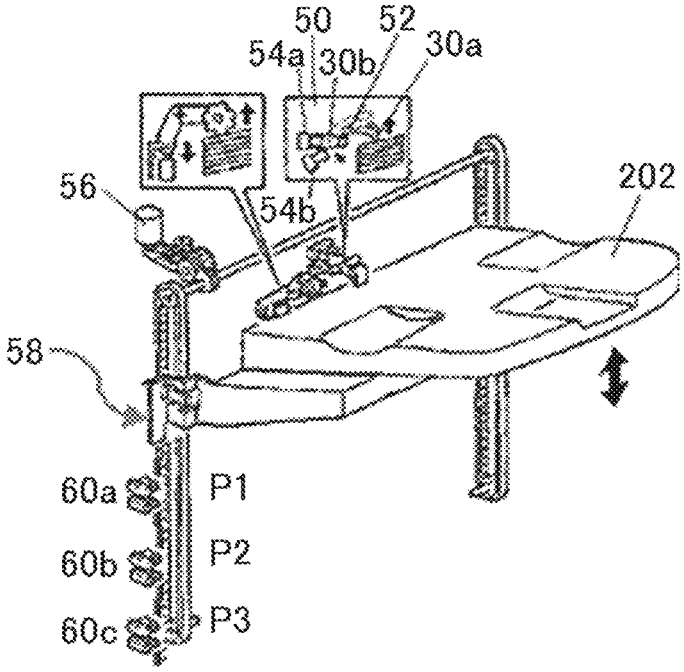
FIG. 14 is a perspective view illustrating an example of a sheet stacking amount detector of the shift tray.

FIG. 14 is a perspective view illustrating an example of a sheet stacking amount detector of the shift tray 202.

A sheet face detector 50 functions as a sheet stacking amount detector to detect the upper face of a sheet stacked on the shift tray 202 and includes a sheet face detection lever 52, a stapling sheet face detection sensor 54*a*, and a non-stapling sheet face detection sensor 54*b*. In other words, the sheet face detector 50 detects the sheet stacking amount of the sheets on the shift trays 201 and 202 separately. The sheet face detection lever 52 rotates about the lever shaft and includes a contact portion 30*a* and a fan-shaped block portion 30*b*. The contact portion 30*a* contacts the trailing end of the upper face of the sheet stacked on the shift tray 202.

When the stapling sheet face detection sensor 54*a* and the non-stapling sheet face detection sensor 54*b* detect that the sheet stacking amount of the sheets on the shift tray 202 has reached a given height, a tray elevation motor 56 lowers the shift tray 202 by a given amount. As a result, the sheet face position of the shift tray 202 is kept substantially constant.

A sensor feeler 58 moves vertically along with the vertical movement of the shift tray 202. A first sheet stacker sensor 60*a*, a second sheet stacker sensor 60*b*, and a third sheet stacker sensor 60*c* detect respective positions of the sensor feeler 58. Due to this detection, the position of the shift tray 202 is estimated, and therefore the sheet stacking amount of the sheets on the shift tray 202 is estimated.

Note that, since the sheet stacking amount detector 800 according to the present embodiment employs the sensor feeler 58, the first sheet stacker sensor 60*a*, the second sheet stacker sensor 60*b*, and the third sheet stacker sensor 60*c* include optical transmission type sensors.

The sheet stacking amount of the sheets on the shift tray 202 increases in the order of the detection positions of sensor feeler positions P1, P2, and P3. When the main power source of the image forming system 600 is turned on, the tray shifting speed of the shift tray 201 and the tray shifting speed of the shift tray 202 are varied by changing the pulse period of the shift motor 36 previously programmed based on the sheet stacker sensor 60 (specifically, the first sheet stacker sensor 60*a*, the second sheet stacker sensor 60*b*, and the third sheet stacker sensor 60*c*).

More specifically, as described in Table 1, a tray shifting speed (m/s) of the shift tray when the first sheet stacker sensor 60*a* detected the sensor feeler 58 is a tray shifting speed SV1, a tray shifting speed (m/s) of the shift tray when the second sheet stacker sensor 60*b* detected the sensor feeler 58 is a tray shifting speed SV2, and a tray shifting speed (m/s) of the shift tray when the third sheet stacker sensor 60*c* detected the sensor feeler 58 is a tray shifting speed SV3. The tray shifting speeds SV1, SV2, and SV3 are controlled to have the relation of SV1>SV2>SV3.

TABLE 1

| Sensor Detected Sensor Feeler 58 | Tray Shifting Speed (m/s) | Pulse Period (Hz) |
|---|---|---|
| First Sheet Stacker Sensor 60a | SV1 | f1 |
| Second Sheet Stacker Sensor 60b | SV2 | f2 |
| Third Sheet Stacker Sensor 60c | SV3 | f3 |

Drive pulses for the shift motor 36 of the shift tray 201 and the shift motor 36 of the shift tray 202 are output from the CPU on the control board of the post-processing apparatus 200 to a motor driver control IC. According to the cycle of these drive pulse periods, a motor driver IC controls the rotation speed of the shift motors 36. By changing the cycles of the drive pulses, the tray shifting speeds of the shift trays 201 and 202 are changed.

The cycles of the drive pulses are set and output arbitrarily to some extent.

Table 1 also describes pulse periods f1, f2, and f3 that are output from the CPU according to detection of turning on of the first sheet stacker sensor 60*a*, the second sheet stacker sensor 60*b*, and the third sheet stacker sensor 60*c*, respectively. The pulse periods f1, f2, and f3 are in the relationship of f1>f2>f3.

When the sheet stacking amount is large (when the mass of the shift tray is large), the image forming system 600 controls to reduce the tray shifting speed SV of the shift tray and not to increase the kinetic energy of the shift tray. By so doing, the force acting on the post-processing apparatus 200 is reduced, and therefore vibration is restrained. Therefore, even when sheets are stacked on the shift tray, vibration in the initial operation is restrained, thereby reducing noise.

Note that the kinetic energy W of the shift tray is expressed in an equation, $W=(1/2)*m*V^2$, where the mass of the shift tray is m (kg) and the speed is V (m/s).

Figure 15:
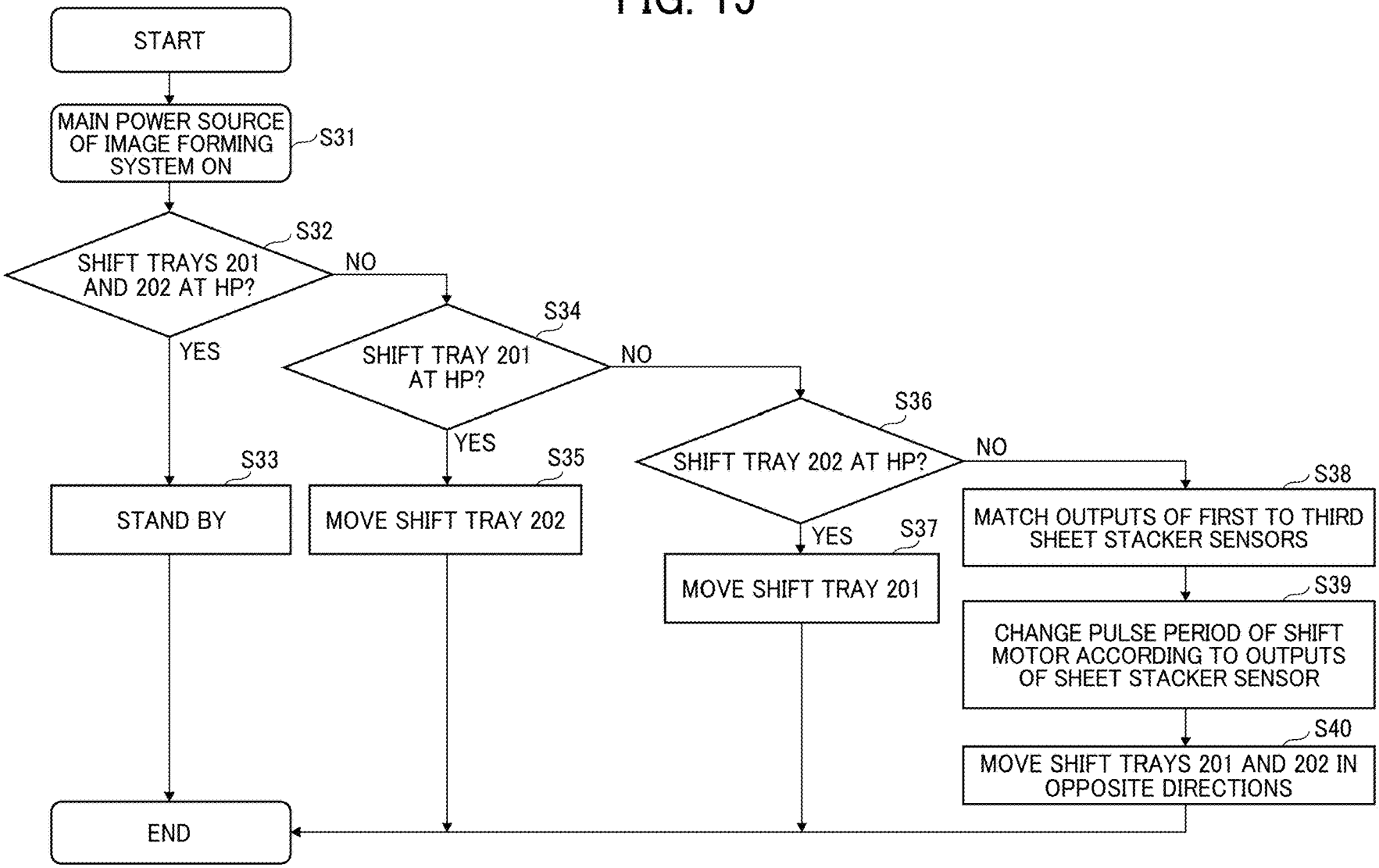
FIG. 15 is a flowchart of the tray shifting operation in an initial operation according to Embodiment 4.

FIG. 15 is a flowchart illustrating the tray shifting operation in the initial operation according to Embodiment 4.

Now, a description is given of the initial operation with a variable tray shifting speed, with reference to the flowchart of FIG. 15. Since steps S31 to S36 in the flowchart of FIG. 15 are the same steps as steps S11 to S16 in the flowchart of FIG. 10 of Embodiment 1 and steps S21 to S26 of the flowchart of FIG. 13, and thus the detailed descriptions of steps S31 to S36 are omitted, and the following description starts from step S36.

In step S36, the post-processing apparatus 200 determines whether the shift tray 202 is at the home position. When the shift tray 202 is at the home position (that is, YES in step S36), the process proceeds to step S37. In step S37, the post-processing apparatus 200 moves the shift tray 201 alone. As a result, since the shift trays 201 and 202 are located at the respective home positions, the initial operation of the post-processing apparatus 200 is completed.

On the other hand, when the shift tray 202 is not at the home position (that is, NO in step S36), the process proceeds to step S38. In step S38, the post-processing apparatus 200 matches the outputs of the first sheet stacker sensor 60*a*, the second sheet stacker sensor 60*b*, and the third sheet stacker sensor 60*c*. Then, the process proceeds to step S39, where the post-processing apparatus 200 changes the pulse period of the shift motor in accordance with the sheet stacker sensor that has been turned ON.

Subsequently, the process proceeds to step S20, where the post-processing apparatus 200 moves the shift trays 201 and 202 in opposite directions to each other. As a result, since the shift trays 201 and 202 are located at the respective home positions, the initial operation of the post-processing apparatus 200 is completed.

As described above, the post-processing apparatus 200 according to the present embodiment changes the tray shifting speed according to the detected sheet stacking amount when the shift trays 201 and 202 move in the opposite directions to each other in the initial operation. Therefore, vibration is further restrained, and noise is reduced.

Embodiment 5

In Embodiments 1 to 4, the descriptions have been given of the post-processing apparatus 200 provided with the two-stage shift tray unit including the upper shift tray (that is, the shift tray 201) and the lower shift tray (that is, the shift tray 202). In Embodiment 5, a description is given of a post-processing apparatus 220 provided with a three-stage shift tray unit including an uppermost shift tray, a middle shift tray, and a lowermost shift tray.

Figure 16:
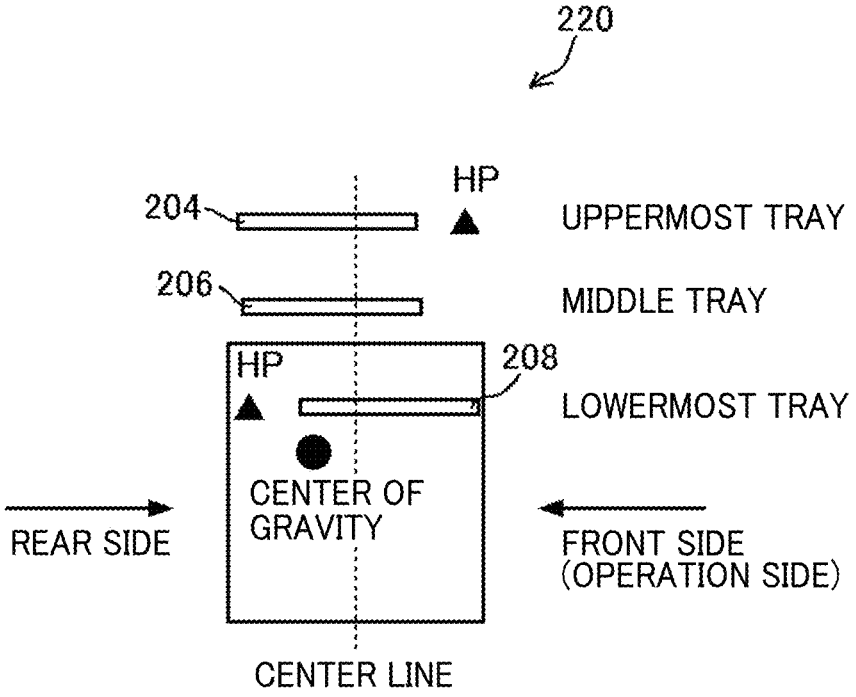
FIG. 16 is a diagram illustrating a post-processing apparatus including three shift trays according to Embodiment 5.

FIG. 16 is a schematic diagram illustrating the post-processing apparatus 220 including three shift trays, according to Embodiment 5.

The post-processing apparatus 220 includes a plurality of shift trays (from the top, the uppermost shift tray 204, the middle shift tray 206, and the lowermost shift tray 208) is disposed in multiple stages in the vertical direction of the housing of the post-processing apparatus 220.

Note that post-processing unit 28 in FIG. 2 also corresponds to the post-processing apparatus 220, and the controller 28*a* is provided in the post-processing apparatus 220 to cause the post-processing apparatus 220 to move the uppermost shift tray 204, the middle shift tray 206, and the lowermost shift tray 208.

The home positions of the uppermost shift tray 204, the middle shift tray 206, and the lowermost shift tray 208. The home position of the shift tray closest to the position of the center of gravity of the post-processing apparatus 220 (here, the lowermost shift tray 208) is set on the side close to the position of the center of gravity of the post-processing apparatus 220 (the rear side of the post-processing apparatus 220). On the other hand, the home position of the shift tray farthest from the position of the center of gravity of the post-processing apparatus 220 (here, the uppermost shift tray 204) is set on the opposite side from the position of the center of gravity of the post-processing apparatus 220 (the front side of the post-processing apparatus 220).

Note that the home position of the uppermost shift tray 204 is set on the front side of the post-processing apparatus 220 in consideration of user's convenience, for example, to make it easier to take out the sheets stacked on the shift tray.

Figure 17:
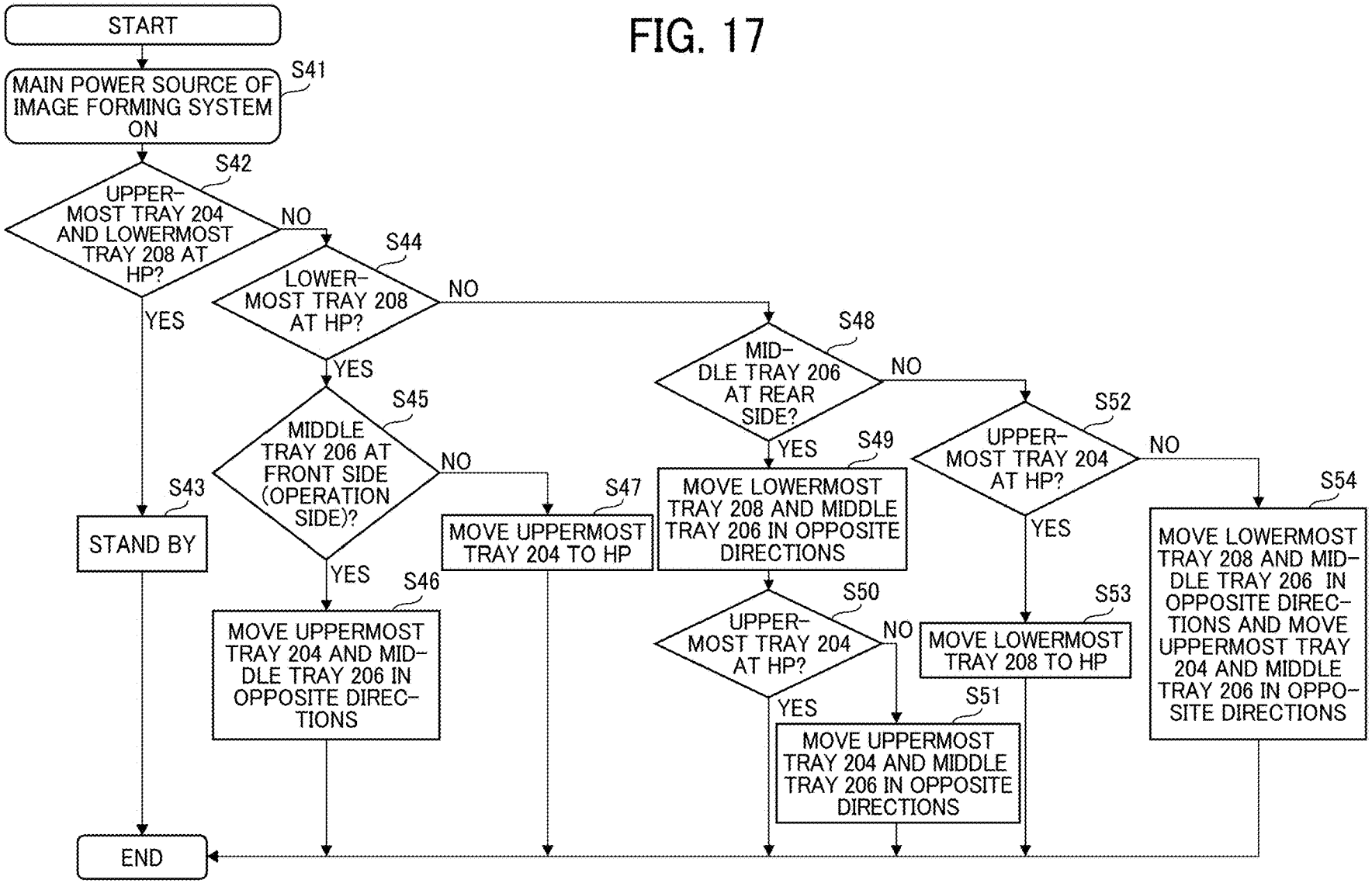
FIG. 17 is a flowchart of the tray shifting operation in an initial operation of the post-processing apparatus including the three shift trays.
Figure 18A:
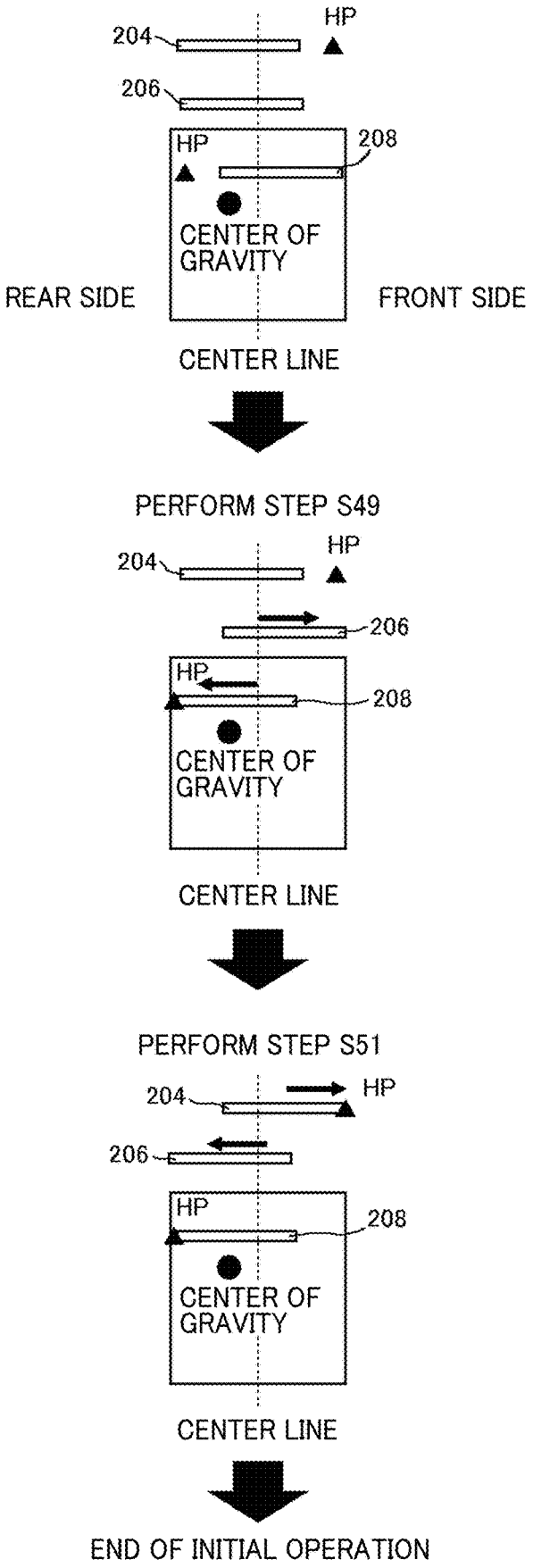
FIG. 18A is a schematic diagram 1 illustrating a state of the three shift trays corresponding to the flowchart of FIG. 17.
Figure 18B:
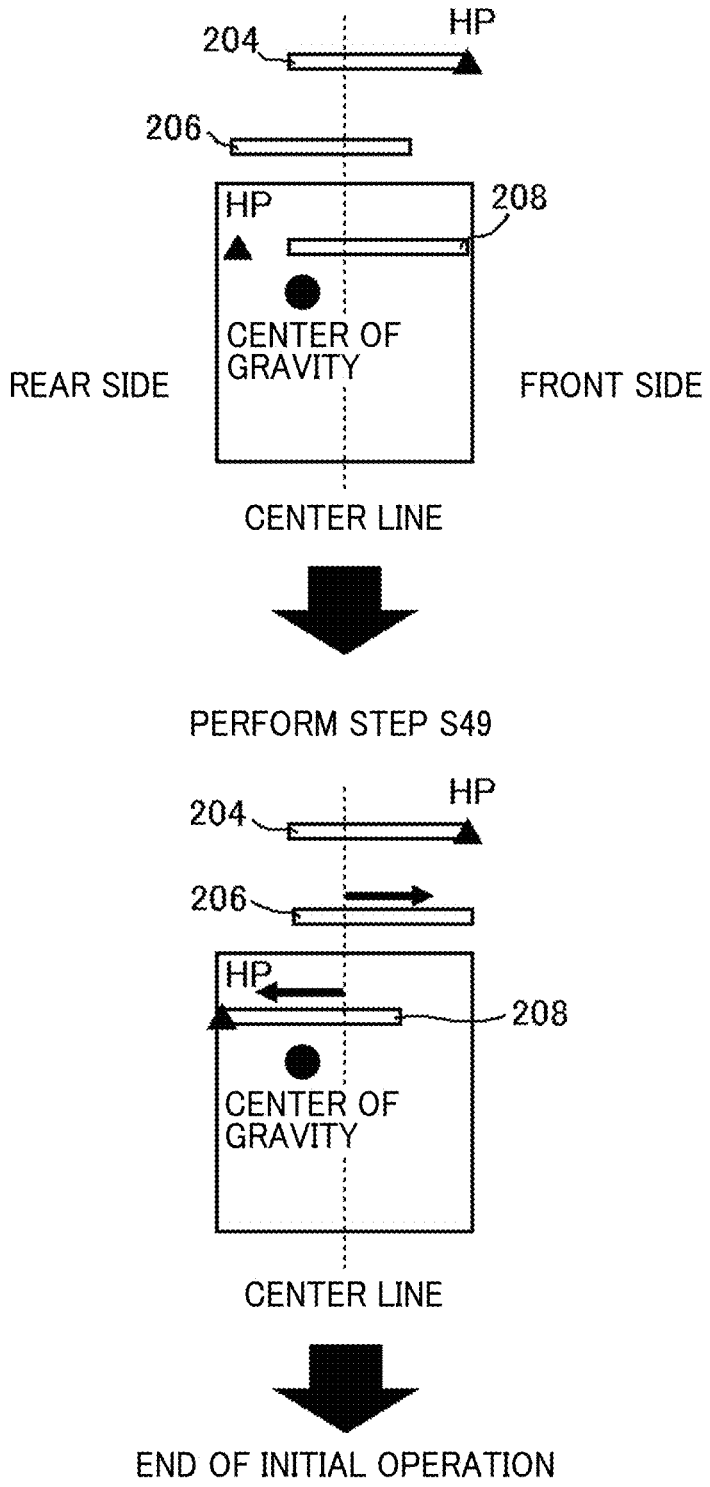
FIG. 18B is a schematic diagram 2 illustrating a state of the three shift trays corresponding to the flowchart of FIG. 17.
Figure 18C:
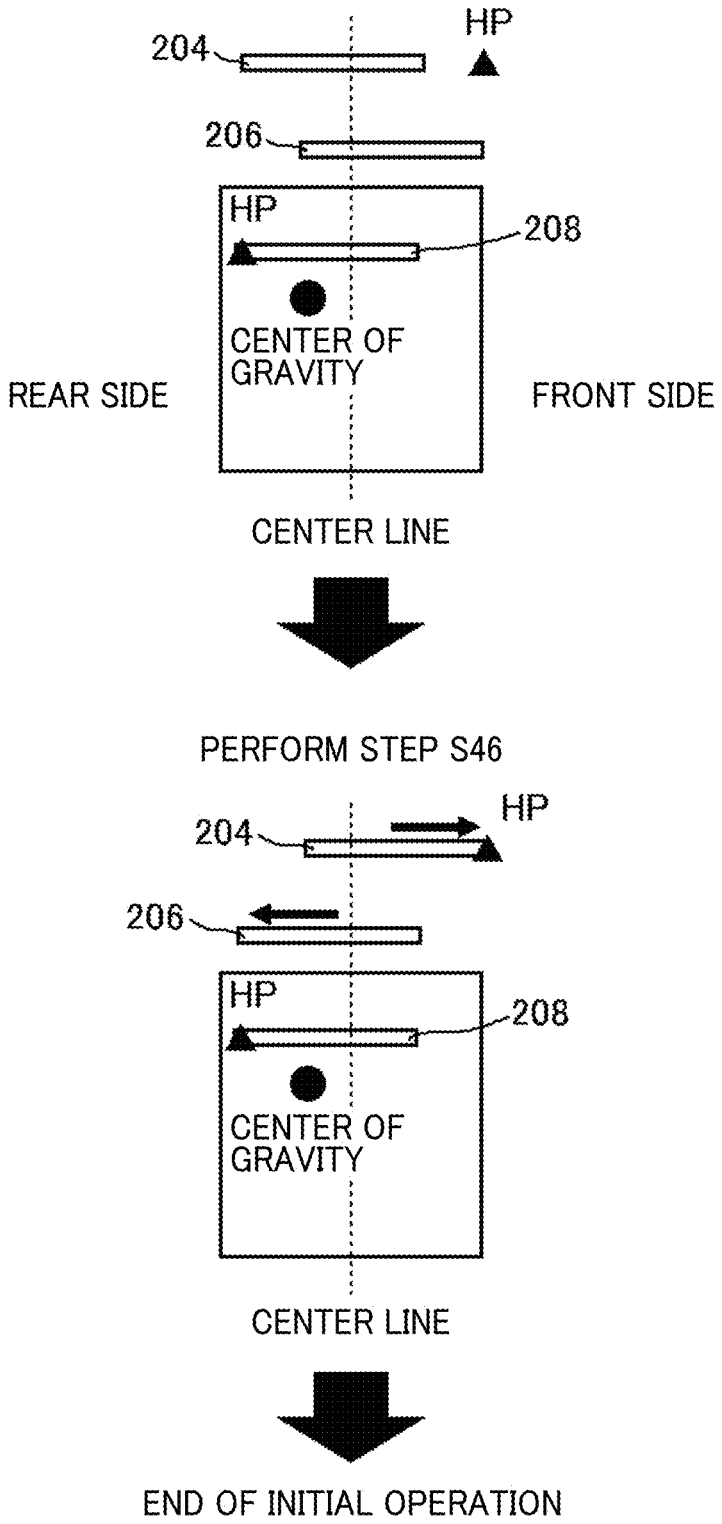
FIG. 18C is a schematic diagram 3 illustrating a state of the three shift trays corresponding to the flowchart of FIG. 17.
Figure 18D:
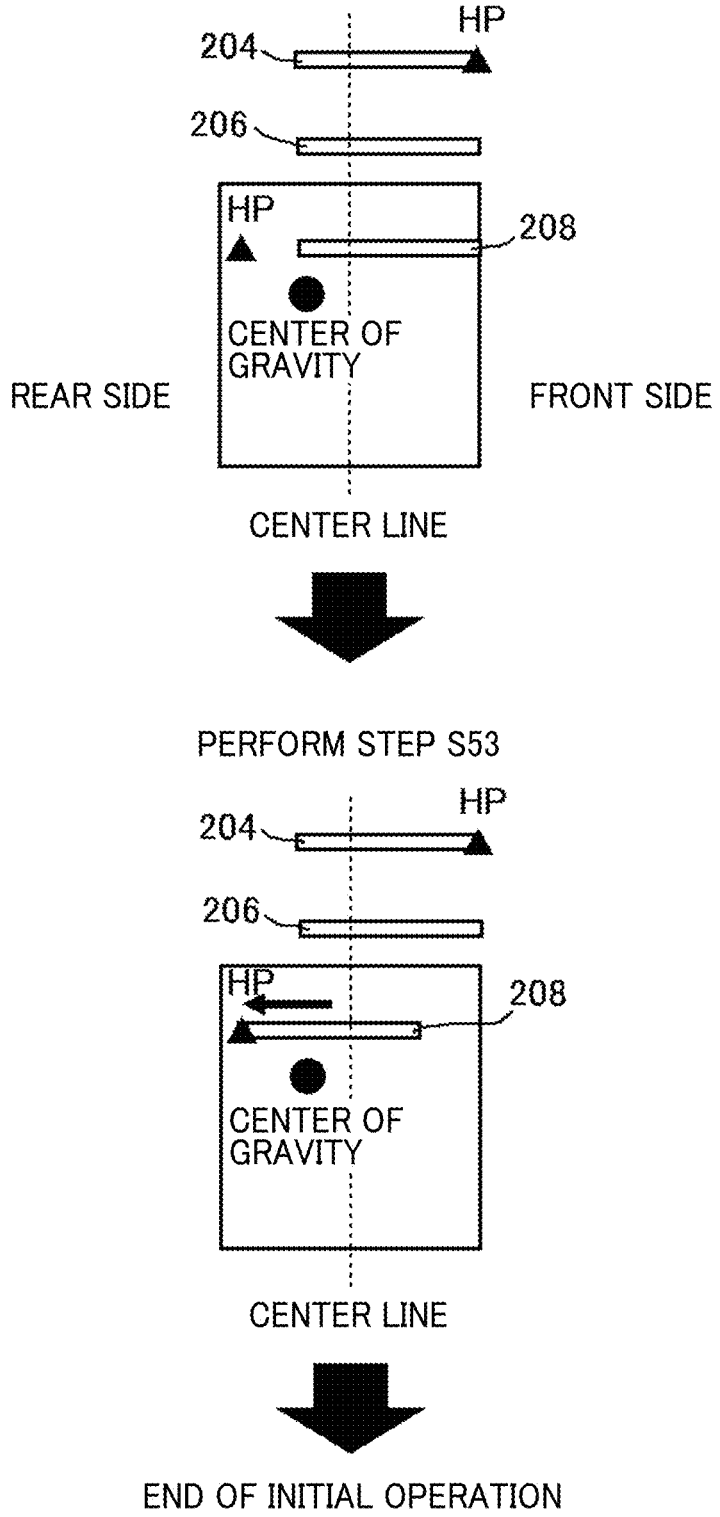
FIG. 18D is a schematic diagram 4 illustrating a state of the three shift trays corresponding to the flowchart of FIG. 17.
Figure 18E:
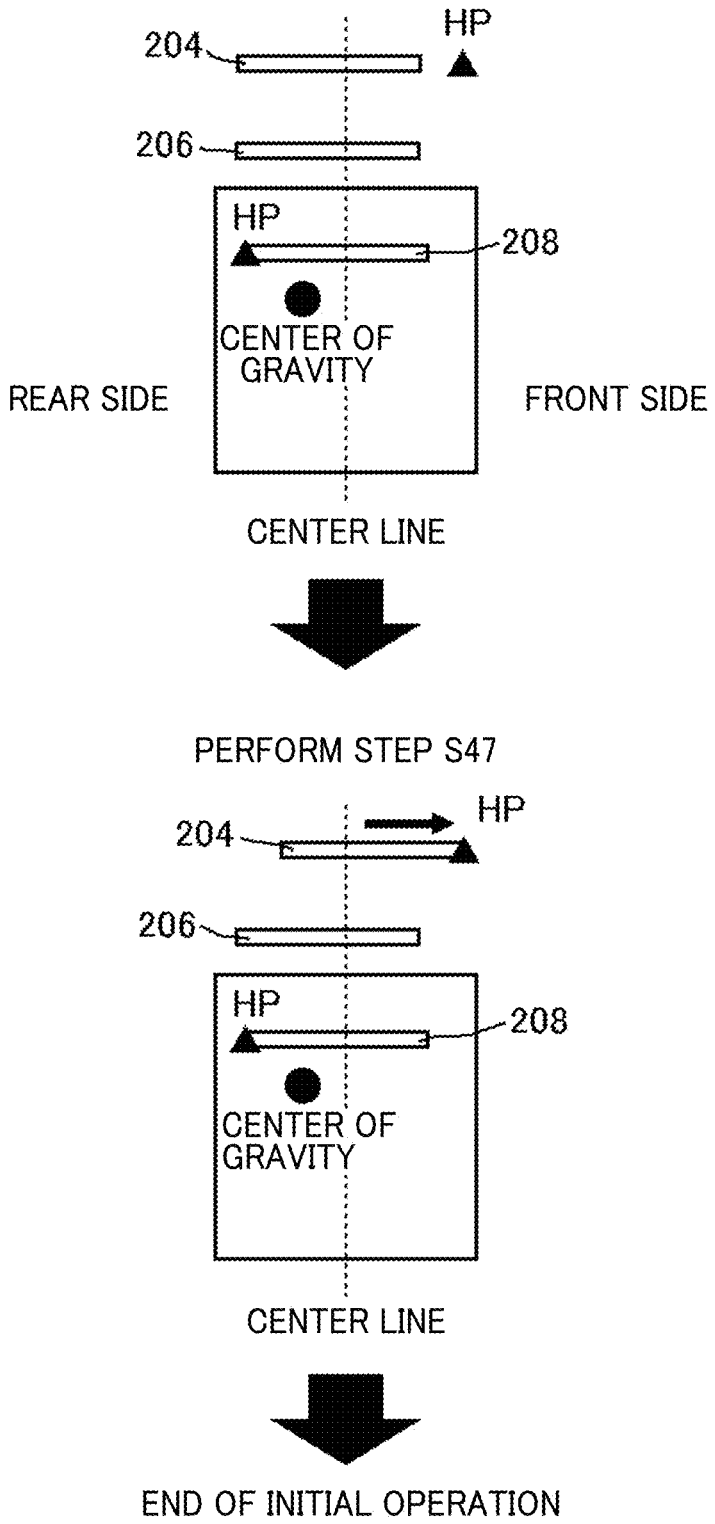
FIG. 18E is a schematic diagram 5 illustrating a state of the three shift trays corresponding to the flowchart of FIG. 17.

FIG. 17 is a flowchart of the tray shifting operation in an initial operation of the post-processing apparatus 220 including the three-stage shift tray unit with the three shift trays. FIGS. 18A to 18E are schematic diagrams illustrating the states of the three-stage shift tray unit in the initial operation of the post-processing apparatus 220. Specifically, FIG. 18A is a schematic diagram 1 illustrating the state of the three shift trays, FIG. 18B is a schematic diagram 2 illustrating the state of the three shift trays, FIG. 18C is a schematic diagram 3 illustrating the state of the three shift trays, FIG. 18D is a schematic diagram 4 illustrating the state of the three shift trays, and FIG. 18E is a schematic diagram 5 illustrating the state of the three shift trays.

A description is given of the initial operations of the three-stage shift tray unit described above, with reference to the flowchart of FIG. 17.

First, in step S41, the main power source of the image forming system 600 is turned on. Next, in step S42, the post-processing apparatus 220 determines whether the uppermost shift tray 204 and the lowermost shift tray 208 are at the respective home positions (HP). When the uppermost shift tray 204 and the lowermost shift tray 208 are at the respective home positions (that is, YES in step S42), the process proceeds to step S43. In step S23, the post-processing apparatus 220 stands by without performing the tray shifting operation.

On the other hand, in step S42, when any of the uppermost shift tray 204 and the lowermost shift tray 208 is not in the respective home positions (that is, NO in step S42, the process proceeds to step S44. In step S44, the post-processing apparatus 220 determines whether the lowermost shift tray 208 is at the home position. When the lowermost shift tray 208 is at the home position (that is, YES in step S44), the process proceeds to step S45. In step S45, the post-processing apparatus 220 determines whether the middle shift tray 206 is at a position on the front side of the post-processing apparatus 220.

In step S45, when the post-processing apparatus 220 determines that the middle shift tray 206 is on the front side of the post-processing apparatus 220 (that is, YES in step S45), the process proceeds to step S46. In step S46, the post-processing apparatus 220 moves the uppermost shift tray 204 and the middle shift tray 206 in directions opposite to each other (see FIG. 18C). As a result, since the uppermost shift tray 204 and the lowermost shift tray 208 are located at the home positions, the initial operation of the post-processing apparatus 220 is completed.

On the other hand, in step S45, when the post-processing apparatus 220 determines that the middle shift tray 206 is not on the front side of the post-processing apparatus 220 (that is, NO in step S45), the process proceeds to step S47. In step S47, the post-processing apparatus 220 moves the uppermost shift tray 204 to the home position (see FIG. 18E). As a result, since the uppermost shift tray 204 and the lowermost shift tray 208 are located at the respective home positions, the initial operation of the post-processing apparatus 220 is completed.

Then, the process returns to step S44. When the post-processing apparatus 220 determines that the lowermost shift tray 208 is not at the home position that is, NO in step S44), the process proceeds to step S48. In step S48, the post-processing apparatus 220 determines whether the middle shift tray 206 is on the rear side of the post-processing apparatus 220.

In step S48, when the post-processing apparatus 220 determines that the middle shift tray 206 is on the rear side of the post-processing apparatus 220 (that is, YES in step S48), the process proceeds to step S49. In step S49, the post-processing apparatus 220 moves the lowermost shift tray 208 and the middle shift tray 206 in directions opposite to each other (see FIG. 18B).

Next, the process proceeds to step S50, where the post-processing apparatus 220 determines whether the uppermost shift tray 204 is at the home position. When the uppermost shift tray 204 is at the home position (YES in step S50), the uppermost shift tray 204 and the lowermost shift tray 208 are located on the respective home positions, and therefore the initial operation of the post-processing apparatus 220 is completed (see FIG. 18B).

On the other hand, when the uppermost shift tray 204 is not at the home position (NO in step S50), the process proceeds to step S51. In step S51, the post-processing apparatus 220 moves the uppermost shift tray 204 and the middle shift tray 206 in directions opposite to each other (see FIG. 18A). As a result, since the uppermost shift tray 204 and the lowermost shift tray 208 are located at the respective home positions, the initial operation of the post-processing apparatus 220 is completed.

Subsequently, the process returns to step S48. In step S48, when the post-processing apparatus 220 determines that the middle shift tray 206 is not on the rear side of the post-processing apparatus 220 (that is, NO in step S48) the process proceeds to step S52. In step S52, the post-processing apparatus 220 determines whether the uppermost shift tray 204 is in the home position.

When the uppermost shift tray 204 is at the home position (that is, YES in step S52), the process proceeds to step S53. In step S53, the lowermost shift tray 208 is moved to the home position (see FIG. 18D). As a result, since the uppermost shift tray 204 and the lowermost shift tray 208 are located at the respective home positions, the initial operation of the post-processing apparatus 220 is completed.

On the other hand, in step S52, when the post-processing apparatus 220 determines that the uppermost shift tray 204 is not at the home position (that is, NO in step S52), the process proceeds to step S54. In step S54, the post-processing apparatus 220 moves the uppermost shift tray 204 and the middle shift tray 206 in directions opposite to each other, and further moves the lowermost shift tray 208 and the middle shift tray 206 in directions opposite to each other. As a result, since the uppermost shift tray 204 and the lowermost shift tray 208 are located at the respective home positions, the initial operation of the post-processing apparatus 220 is completed.

As described above, the post-processing apparatus 220 of the present embodiment determines whether the positions of the uppermost shift tray and the lowermost shift tray are at the home positions in the initial operation. Then, only when either the uppermost shift tray or the lowermost shift tray is to be moved to the home position, the tray to be moved (that is, either the uppermost shift tray or the lowermost shift tray) and an adjacent tray disposed adjacent to the tray to be moved are moved in directions opposite to each other, so that the vibration is canceled. That is, the adjacent tray that is moved adjacently to the tray to be moved is a tray movable in the opposite direction to the uppermost shift tray or the lowermost shift tray.

However, if there is no adjacent tray to move in the direction opposite the direction of the tray to be moved, the tray is moved separately.

As described above, since the post-processing apparatus 220 according to the present embodiment moves the shift trays adjacent to each other in directions opposite to each other in the initial operation, vibration is restrained, and noise is reduced.

This disclosure has been explained in detail with the above-described embodiments but is not limited to the embodiments. For example, a plurality of embodiments described above may be combined.

Further, note that any sheet sorting device, post-processing apparatus, and image forming apparatus may be employed as long as these configurations are applicable to this disclosure.

It is to be noted that a "sheet" in the above-described embodiments of this disclosure is not limited to indicate a (regular) paper but also includes any other sheet-like recording medium such as plastic film, cloth, metal sheet, and the like.

The above-described embodiments are illustrative and do not limit this disclosure. Thus, numerous additional modifications and variations are possible in light of the above teachings. For example, elements and/or features of different illustrative embodiments may be combined with each other and/or substituted for each other within the scope of this disclosure.

In the above-described embodiments, the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., an OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, the size (dimension), material, shape, and relative positions used to describe each of the components and units are examples, and the scope of this disclosure is not limited thereto unless otherwise specified. Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

The effects described in the embodiments of this disclosure are listed as the examples of preferable effects derived from this disclosure, and therefore are not intended to limit to the embodiments of this disclosure.

The embodiments described above are presented as examples to implement this disclosure and are not intended to limit the scope of this disclosure. These novel embodiments can be implemented in various other forms, and various omissions, replacements, or changes can be made without departing from the gist of this disclosure. These embodiments and their variations are included in the scope and gist of this disclosure, and are included in the scope of this disclosure recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet sorting device comprising:

a plurality of trays disposed in multiple stages in a vertical direction and configured to stack a sheet from an image forming apparatus;

a tray shifter configured to move the plurality of trays separately in a tray shift direction perpendicular to a sheet conveyance direction in which the sheet is conveyed;

a tray stop position detector configured to detect respective stop positions of the plurality of trays separately; and circuitry configured to cause the tray shifter to move the plurality of trays to respective home positions in an initial operation, at least one tray of the plurality of trays having a home position opposite to a home position of another tray of the plurality of trays in the tray shift direction, the circuitry being configured to, while the plurality of trays moves at a same time in the initial operation, cause the tray shifter to move the at least one tray and said another tray in directions opposite to each other.

2. The sheet sorting device according to claim 1, wherein, when the at least one tray and said another tray move in the directions opposite to each other, the circuitry is configured to cause the tray shifter to simultaneously complete movement of the at least one tray and said another tray in the directions opposite to each other.

3. The sheet sorting device according to claim 1, wherein, in the initial operation, the circuitry is configured to cause the tray shifter to move adjacent trays of the plurality of trays in directions opposite to each other and one tray of the plurality of trays in the tray shift direction.

4. The sheet sorting device according to claim 1, wherein, in the initial operation, the circuitry is configured to cause the tray shifter to move adjacent trays of the plurality of trays in directions opposite to each other or one tray of the plurality of trays in the tray shift direction.

5. The sheet sorting device according to claim 1, wherein a home position of a lowermost tray of the plurality of trays is on a same side as a position of a center of gravity of the sheet sorting device relative to a center line of the sheet sorting device in the tray shift direction and a home position of an uppermost tray of the plurality of trays is on an opposite side to the position of the center of gravity of the sheet sorting device relative to the center line of the sheet sorting device in the tray shift direction.

6. The sheet sorting device according to claim 1, wherein, in the initial operation, a tray shifting speed of an uppermost tray of the plurality of trays is slower than a tray shifting speed of a lowermost tray of the plurality of trays.

7. The sheet sorting device according to claim 1, further comprising a sheet stacking amount detector configured to detect a sheet stacking amount of each of the plurality of trays, wherein the circuitry is configured to cause the tray shifter to change a tray shifting speed of a tray of the plurality of trays according to the sheet stacking amount detected by the sheet stacking amount detector, in the initial operation of the sheet sorting device.

8. A post-processing apparatus comprising:

the sheet sorting device according to claim 1; and a sheet processing device configured to perform a post-processing to the sheet.

9. An image forming system comprising:

an image forming apparatus configured to form an image on a sheet; and the sheet sorting device according to claim 1, configured to sort the sheet on which the image is formed by the image forming apparatus.

10. A post-processing apparatus comprising:

a plurality of trays disposed in multiple stages in a vertical direction and configured to stack a sheet from an image forming apparatus;

a tray shifter configured to move the plurality of trays separately in a tray shift direction perpendicular to a sheet conveyance direction in which the sheet is conveyed;

a tray stop position detector configured to detect respective stop positions of the plurality of trays separately; and circuitry configured to cause the tray shifter to move the plurality of trays to respective home positions in an initial operation, at least one tray of the plurality of trays having a home position opposite to a home position of another tray of the plurality of trays in the tray shift direction, the circuitry being configured to, while the plurality of trays moves at a same time in the initial operation, cause the tray shifter to move the at least one tray and said another tray in directions opposite to each other.

11. The post-processing apparatus according to claim 10, wherein, when the at least one tray and said another tray move in the directions opposite to each other, the circuitry is configured to cause the tray shifter to simultaneously complete movement of the at least one tray and said another tray in the directions opposite to each other.

12. The post-processing apparatus according to claim 10, wherein, in the initial operation, the circuitry is configured to cause the tray shifter to move adjacent trays of the plurality of trays in directions opposite to each other and one tray of the plurality of trays in the tray shift direction.

13. The post-processing apparatus according to claim 10, wherein, in the initial operation, the circuitry is configured to cause the tray shifter to move adjacent trays of the plurality of trays in directions opposite to each other or one tray of the plurality of trays in the tray shift direction.

14. The post-processing apparatus according to claim 10, wherein a home position of a lowermost tray of the plurality of trays is on a same side as a position of a center of gravity of the post-processing apparatus relative to a center line of the post-processing apparatus in the tray shift direction and a home position of an uppermost tray of the plurality of trays is on an opposite side to the position of the center of gravity of the post-processing apparatus relative to the center line of the post-processing apparatus in the tray shift direction.

15. The post-processing apparatus according to claim 10, wherein, in the initial operation, a tray shifting speed of an uppermost tray of the plurality of trays is slower than a tray shifting speed of a lowermost tray of the plurality of trays.

16. The post-processing apparatus according to claim 10, further comprising a sheet stacking amount detector configured to detect a sheet stacking amount of each of the plurality of trays, wherein the circuitry is configured to cause the tray shifter to change a tray shifting speed of a tray of the plurality of trays according to the sheet stacking amount detected by the sheet stacking amount detector, in the initial operation of the post-processing apparatus.

17. An image forming system comprising:

an image forming apparatus configured to form an image on a sheet; and the post-processing apparatus according to claim 10, configured to perform the post-processing to the sheet on which the image is formed by the image forming apparatus.

18. An image forming system comprising:

an image forming apparatus configured to form an image on a sheet;

a sheet sorting device configured to sort the sheet on which the image is formed by the image forming apparatus, the sheet sorting device including a plurality of trays disposed in multiple stages in a vertical direction and configured to stack the sheet from the image forming apparatus;

a tray shifter configured to move the plurality of trays separately in a tray shift direction perpendicular to a sheet conveyance direction in which the sheet is conveyed; and a tray stop position detector configured to detect respective stop positions of the plurality of trays separately; and circuitry configured to cause the tray shifter to move the plurality of trays to respective home positions in an initial operation, at least one tray of the plurality of trays having a home position opposite to a home position of another tray of the plurality of trays in the tray shift direction, the circuitry being configured to, while the plurality of trays moves at a same time in the initial operation, cause the tray shifter to move the at least one tray and said another tray in directions opposite to each other.

19. An image forming system comprising:

an image forming apparatus configured to form an image on a sheet;

a post-processing apparatus configured to perform the post-processing to the sheet on which the image is formed by the image forming apparatus, the sheet sorting device including a plurality of trays disposed in multiple stages in a vertical direction and configured to stack the sheet from the image forming apparatus;

a tray shifter configured to move the plurality of trays separately in a tray shift direction perpendicular to a sheet conveyance direction in which the sheet is conveyed; and a tray stop position detector configured to detect respective stop positions of the plurality of trays separately; and circuitry configured to cause the tray shifter to move the plurality of trays to respective home positions in an initial operation, at least one tray of the plurality of trays having a home position opposite to a home position of another tray of the plurality of trays in the tray shift direction, the circuitry being configured to, while the plurality of trays moves at a same time in the initial operation, cause the tray shifter to move the at least one tray and said another tray in directions opposite to each other.

* * * * *